US007111931B2

(12) United States Patent
Amma et al.

(10) Patent No.: US 7,111,931 B2
(45) Date of Patent: Sep. 26, 2006

(54) INK TANK

(75) Inventors: Hiromasa Amma, Kanawaga (JP); Toshihiko Ujita, Kanagawa (JP); Yasuo Kotaki, Kanagawa (JP); Keisuke Matsuo, Kanawaga (JP); Kenji Kitabatake, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 266 days.

(21) Appl. No.: 10/847,574

(22) Filed: May 18, 2004

(65) Prior Publication Data

US 2004/0233259 A1 Nov. 25, 2004

(30) Foreign Application Priority Data

May 22, 2003 (JP) ..... 2003-145470

(51) Int. Cl.
*B41J 2/175* (2006.01)
*B41J 2/17* (2006.01)

(52) U.S. Cl. ..... 347/86; 347/94

(58) Field of Classification Search ..... 347/85, 347/86, 87, 94; 137/115.13, 859
See application file for complete search history.

(56) References Cited

U.S. PATENT DOCUMENTS 4,677,447 A * 6/1987 Nielsen ..... 347/87
5,055,856 A * 10/1991 Tomii et al. ..... 347/30
5,653,215 A * 8/1997 Chung et al. ..... 124/66
5,777,646 A * 7/1998 Barinaga et al. ..... 347/86
6,361,159 B1 * 3/2002 Chino ..... 347/86
6,935,730 B1 * 8/2005 Qingguo et al. ..... 347/86
7,011,397 B1 * 3/2006 Miyazawa et al. ..... 347/86
2002/0109760 A1 8/2002 Miyazawa et al. ..... 347/86

FOREIGN PATENT DOCUMENTS

| | | |
|---|---|---|
| CN | 1130569 | 9/1996 |
| JP | 2003-34041 | 2/2003 |
| JP | 2003-127414 | 5/2003 |
| WO | 03/037634 | 5/2003 |

* cited by examiner

*Primary Examiner*—Anh T. N. Vo
(74) *Attorney, Agent, or Firm*—Fitzpatrick, Cella, Harper & Scinto

(57) ABSTRACT

An ink tank is provided which can apply an optimum negative pressure stably by a valve of a simple structure. To this end, the ink tank of this invention has a valve and a damper section installed in an ink flow path. The valve deforms when the negative pressure in the ink supply port is greater than a predetermined level, to temporarily open the ink flow path to introduce ink from the ink accommodation portion to the ink supply port. The damper section is installed between and communicates to the ink supply port and the valve in the ink flow path. The damper section is formed of a resilient member more easily deformed than the valve and applies a negative pressure to the interior of the ink supply port by an elastic recovery force of the resilient member.

14 Claims, 25 Drawing Sheets

FIG.12A
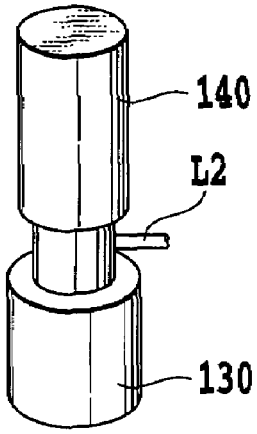
FIG.12B
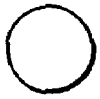
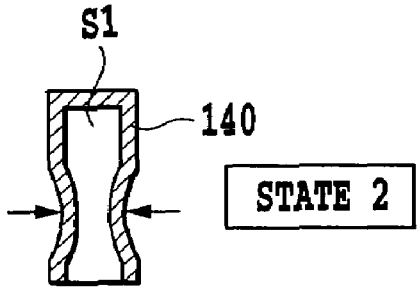
FIG.12E
FIG.12C
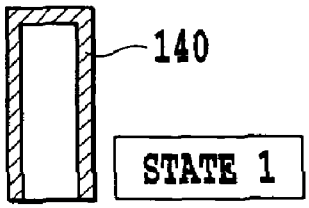
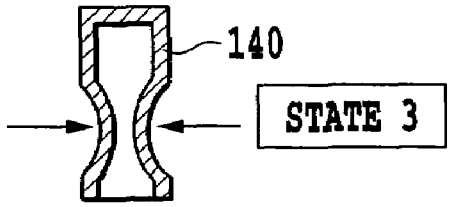
FIG.12F
FIG.12D
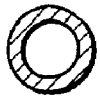

FIG.13A
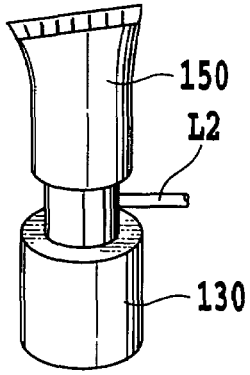
FIG.13B
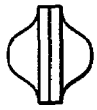
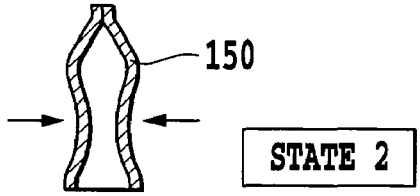
FIG.13E
FIG.13C
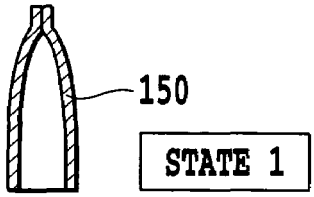
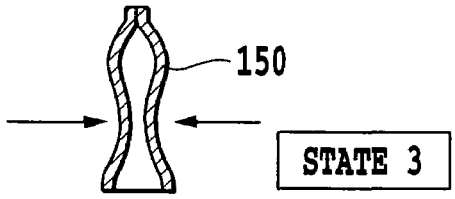
FIG.13F
FIG.13D
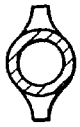

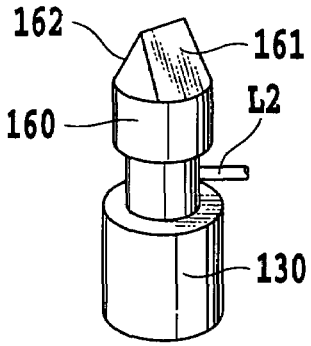
FIG.14A
FIG.14B
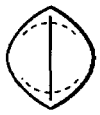
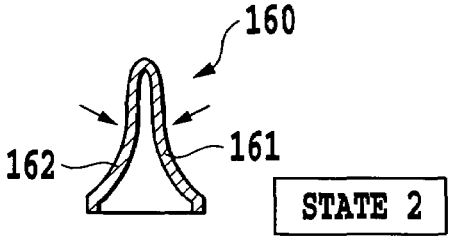
FIG.14E
FIG.14C
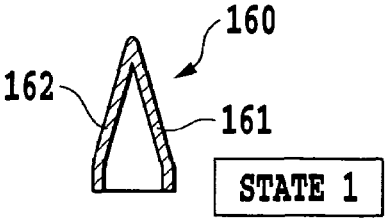
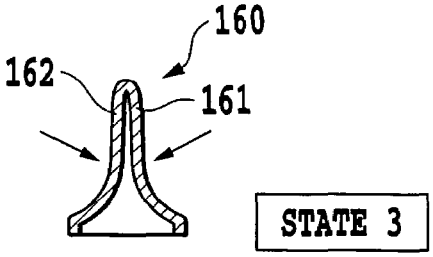
FIG.14F
FIG.14D
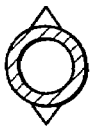

INK TANK

This application claims priority from Japanese Patent Application No. 2003-145470 filed May 22, 2003, which is incorporated hereinto by reference.

BACKGROUND OF THE INVENTION

1. Field of the Invention

The present invention relates to an ink tank having an ink accommodation space therein and capable of supplying ink to the outside of the accommodation space while keeping a pressure in the accommodation space at a predetermined negative pressure at all times.

2. Description of the Related Art

An example of a conventional ink tank of this kind has a negative pressure generation means in the form of a valve structure constructed of a film disk and a spring, as described in Japanese Patent Application Laid-open No. 2003-34041. This ink tank has an ink accommodation portion and an ink supply path formed between the ink accommodation portion and an ink supply port for supplying ink to a print head. In this ink supply path the negative pressure generation means is provided in the form of a valve structure. The valve structure of the negative pressure generation means has its film disk pressed against a valve seat by a biasing force of a spring to normally close the ink supply path. When, as a result of ink ejection from the print head, the negative pressure of ink in the supply path from the supply port to the film disk (a supply path on the supply port side) exceeds a predetermined level, the film disk parts from the valve seat against the biasing force of the spring to open the ink supply path. With the film disk open, ink is supplied from the ink accommodation portion to the supply port through the ink supply path. As a result, the negative pressure in the supply path on the supply port side returns to less than the predetermined level (i.e., the pressure increases) and the film disk is again pressed against the valve seat by the force of the spring to close the ink supply path.

In the conventional ink tank as described above, the negative pressure in the supply path on the supply port side is kept at less than a predetermined level by the open-close action of the film disk to maintain the pressure in the print head communicating with the ink supply path at a negative pressure. As a result, an appropriate meniscus is formed in each of the nozzles of the print head.

The ink tank disclosed in Japanese Patent Application Laid-open No. 2003-34041, however, has the following drawbacks. The use of a spring to bias the film disk increases the number of parts of the ink tank. In terms of assembly, an additional part, spring, may lower the manufacturing efficiency of the ink tank. If the spring is mounted at a deviated position, the biasing force applied to the film disk will vary. This necessitates an additional structure for restricting the spring mounting position. That is, a small component of spring must be assembled precisely by restricting its mounting position, which degrades an assembly efficiency of the ink tank. Furthermore, since the spring is in contact with ink, a material of the spring needs to be chosen which does not degrade the spring function upon contact with ink nor adversely affect the property of ink. An appropriate selection of the spring material is therefore difficult to make and, depending on circumstances, an ink composition may have to be changed.

SUMMARY OF THE INVENTION

An object of this invention is to solve the aforementioned problems and to provide an ink tank capable of applying an optimum negative pressure stably by a valve of simple construction.

According to a first aspect, this invention provides an ink tank comprising: an ink accommodation portion; an ink supply port; an ink flow path formed between the ink accommodation portion and the ink supply port; a valve installed in the ink flow path, the valve being deformed to temporarily open the ink flow path to introduce ink from the ink accommodation portion to the ink supply port; and a damper means installed in the ink flow path between, and communicating to, the ink supply port and the valve; wherein the damper means has a resilient member more easily deformable than the valve and applies a negative pressure to an interior of the ink supply port by an elastic recovery force of the resilient member.

According to a second aspect, this invention provides an ink tank comprising: an ink accommodation portion; an ink supply port; an ink flow path formed between the ink accommodation portion and the ink supply port; a valve installed in the ink flow path, the valve being deformed when a pressure in the ink supply port falls below a predetermined pressure, to temporarily open the ink flow path to introduce ink from the ink accommodation portion to the ink supply port; and a damper means installed in the ink flow path between, and communicating to, the ink supply port and the valve; wherein the damper means has a resilient member adapted to deform prior to the valve as ink is drawn out from the ink supply port, and the damper means can apply a negative pressure to an interior of the ink supply port by an elastic recovery force of the resilient member.

According to a third aspect, this invention provides an ink tank comprising: an ink accommodation portion; an ink supply port; an ink flow path formed between the ink accommodation portion and the ink supply port; a valve installed in the ink flow path, the valve being deformed when a pressure in the ink supply port falls below a predetermined pressure, to temporarily open the ink flow path to introduce ink from the ink accommodation portion to the ink supply port; and a damper means installed in the ink flow path between, and communicating to, the ink supply port and the valve; wherein the damper means begins an elastic deformation at less than a predetermined pressure, some of the elastic deformation of the damper means remains after the valve has opened and closed the ink flow path, and the damper means applies an ink retaining force to an interior of the ink supply port by the residual elastic deformation.

In the ink tank of this invention as described above, a valve and a damper are independently provided in the ink flow path between the ink accommodation space and the ink supply port; the valve is opened when the negative pressure in the ink flow path running from the ink supply port to the valve is greater than a predetermined level; and after the valve is closed, a negative pressure is created in the ink flow path from the damper to the ink supply port by an elastic recovery force of the damper. This construction makes it possible to apply a stable negative pressure at all times to the print head connected to the ink supply port, thereby forming appropriate meniscuses in the nozzles of the print head. This in turn assures appropriate ejection of ink droplets, good quality of printed image and prevention of inadvertent leakage of ink from the nozzles.

The above and other objects, effects, features and advantages of the present invention will become more apparent from the following description of embodiments thereof taken in conjunction with the accompanying drawings.

BRIEF DESCRIPTION OF THE DRAWINGS

FIG. 12A is a perspective view of a damper mounted on a head mounting portion in the first embodiment of this invention;

FIG. 12B is a top view of the damper of FIG. 12A in the first embodiment of this invention;

FIG. 12C is a vertical cross-sectional side view of the damper in state 1 in the first embodiment of this invention;

FIG. 12D is a bottom view of the damper in the first embodiment of this invention;

FIG. 12E is a vertical cross-sectional side view of the damper in state 2 in the first embodiment of this invention;

FIG. 12F is a vertical cross-sectional side view of the damper in state 3 in the first embodiment of this invention;

FIG. 13A is a perspective view of a damper mounted on the head mounting portion in a first variation of the first embodiment of this invention;

FIG. 13B is a top view of the damper of FIG. 13A in the first variation of the first embodiment of this invention;

FIG. 13C is a vertical cross-sectional side view of the damper in state 1 in the first variation of the first embodiment of this invention;

FIG. 13D is a bottom view of the damper in the first variation of the first embodiment of this invention;

FIG. 13E is a vertical cross-sectional side view of the damper in state 2 in the first variation of the first embodiment of this invention;

FIG. 13F is a vertical cross-sectional side view of the damper in state 3 in the first variation of the first embodiment of this invention;

FIG. 14A is a perspective view of a damper mounted on the head mounting portion in a second variation of the first embodiment of this invention;

FIG. 14B is a top view of the damper of FIG. 14A in the second variation of the first embodiment of this invention;

FIG. 14C is a vertical cross-sectional side view of the damper in state 1 in the second variation of the first embodiment of this invention;

FIG. 14D is a bottom view of the damper in the second variation of the first embodiment of this invention;

FIG. 14E is a vertical cross-sectional side view of the damper in state 2 in the second variation of the first embodiment of this invention;

FIG. 14F is a vertical cross-sectional side view of the damper in state 3 in the second variation of the first embodiment of this invention;

DETAILED DESCRIPTION OF PREFERRED EMBODIMENTS

Now, referring to the accompanying drawings, a "basic construction and operation" and a "characteristic construction and operation" will be explained.

[Basic Construction and Operation]

Figure 5:
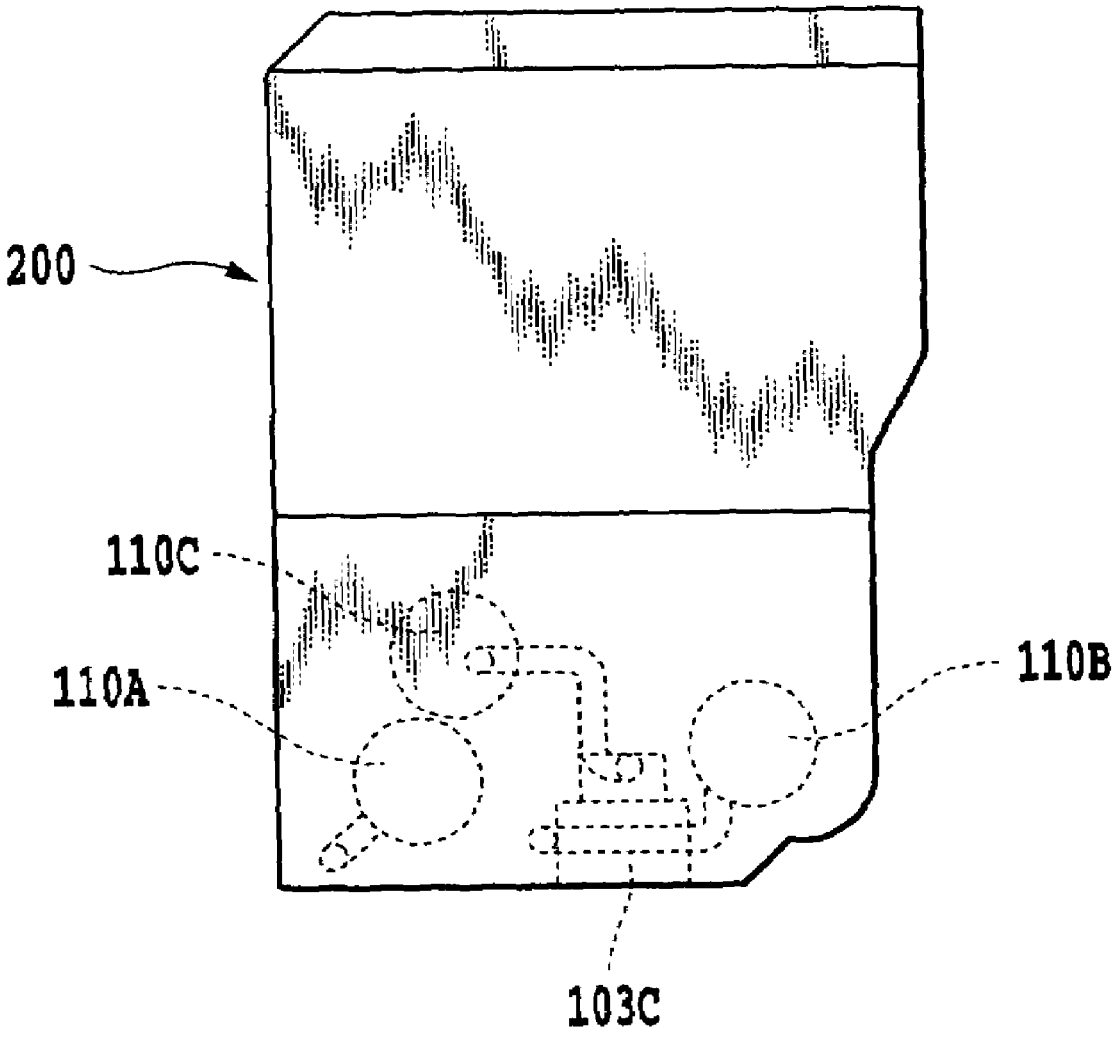
FIG. 5 is a schematic diagram showing a basic construction of an ink tank accommodating a plurality of color inks.
Figure 6:
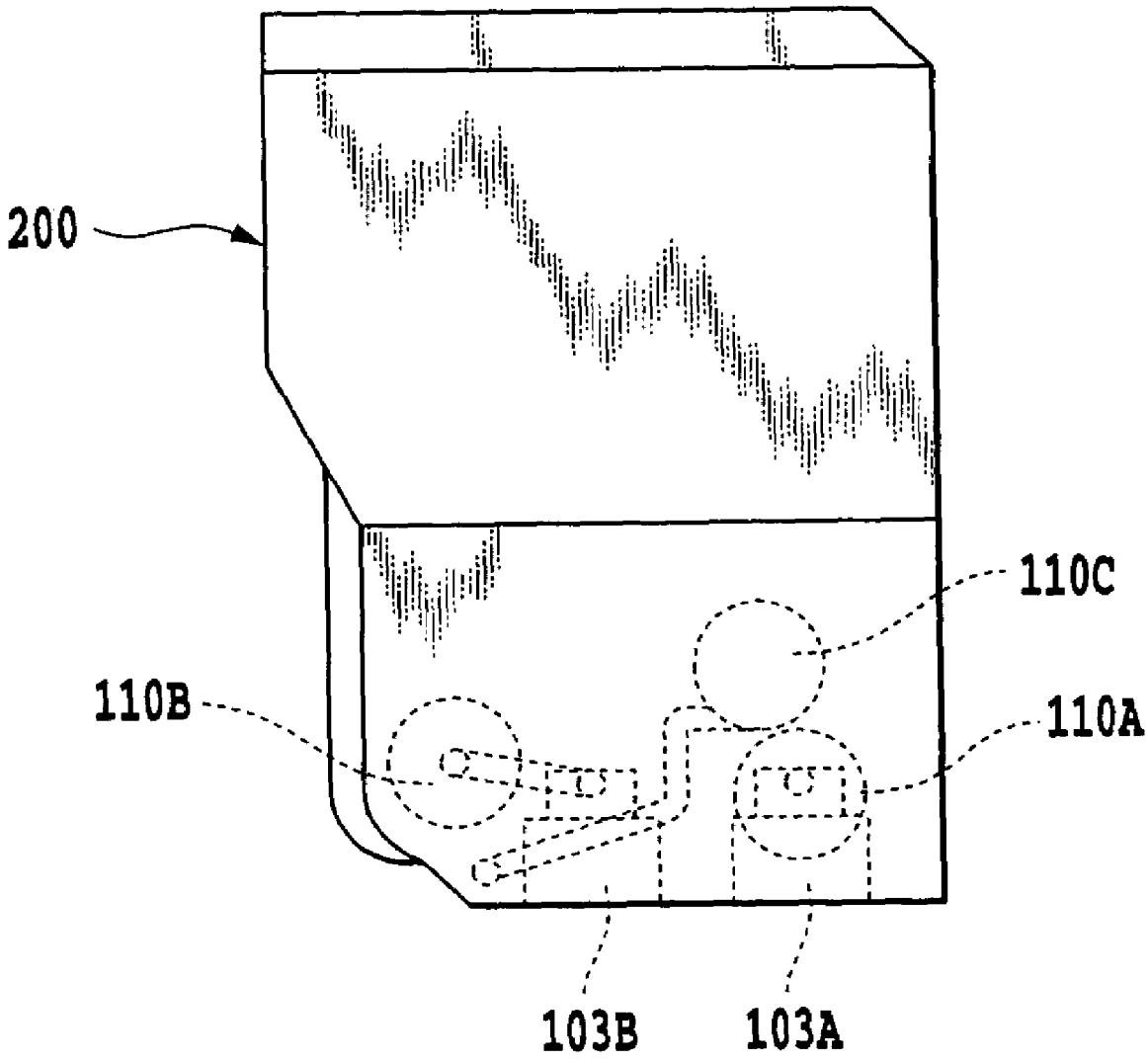
FIG. 6 is a rear view of the ink tank of FIG. 5.
Figure 7:
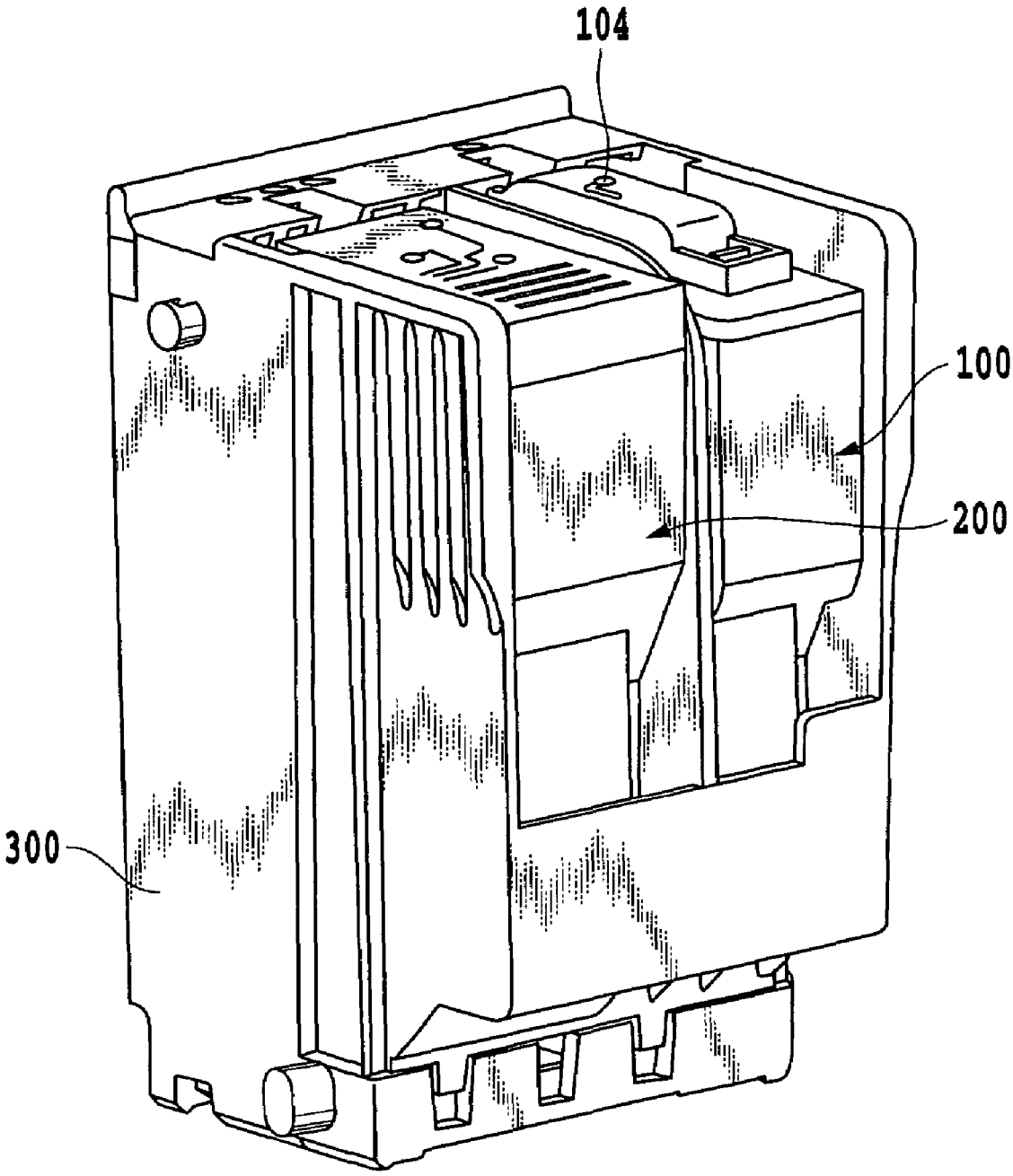
FIG. 7 is a perspective view of a head cartridge in which the ink tank shown in FIG. 5 and FIG. 6 can be mounted.
Figure 8:
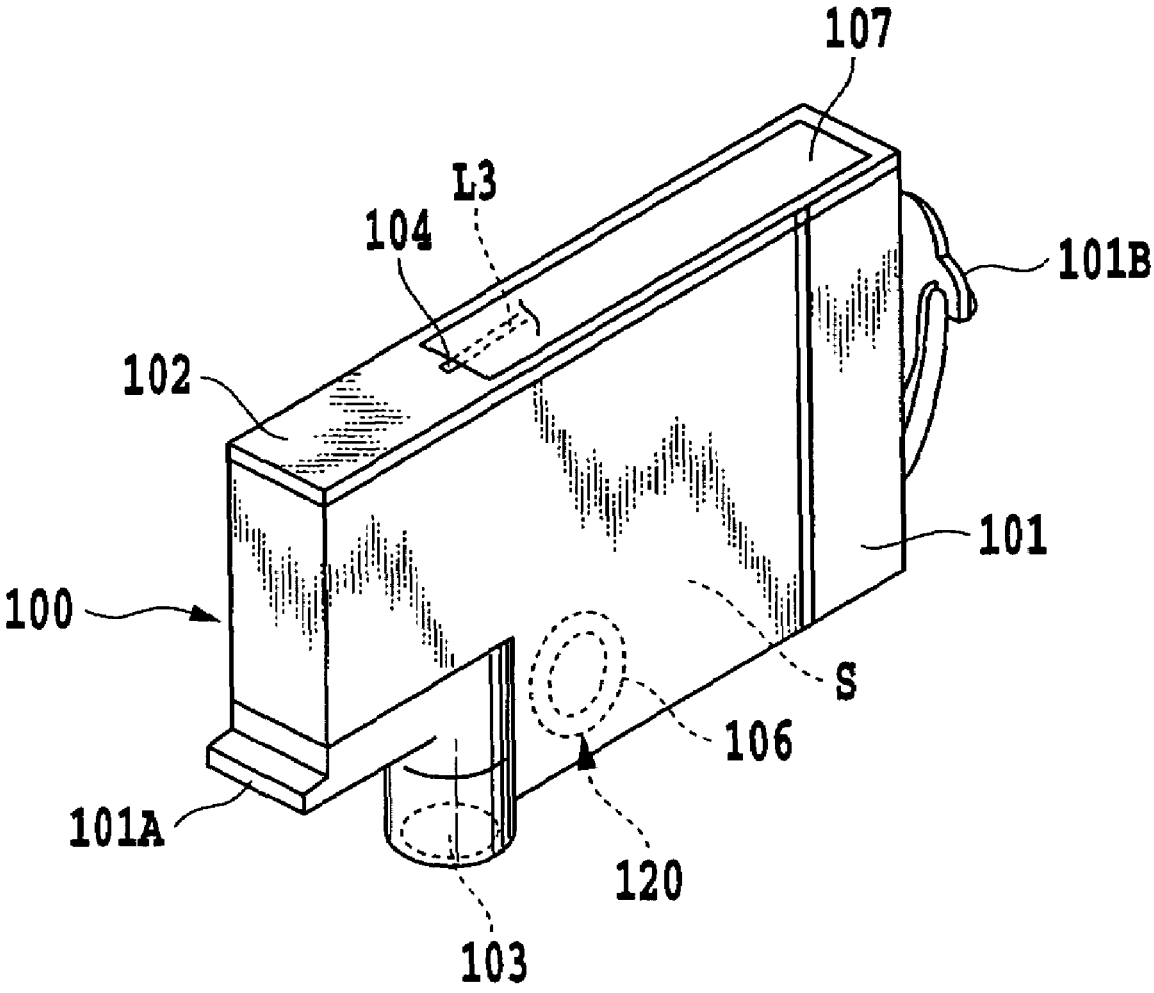
FIG. 8 is a schematic diagram showing another construction of an ink tank accommodating a single color ink.
Figure 9A:
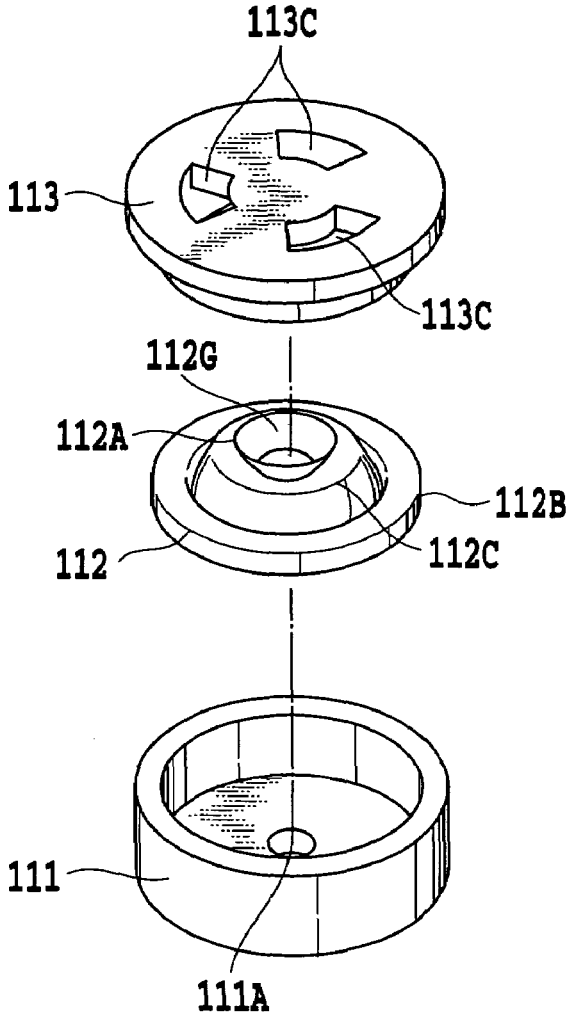
FIGS. 9A and 9B are exploded perspective views showing a construction of a valve provided in embodiments of this invention.
Figure 9B:
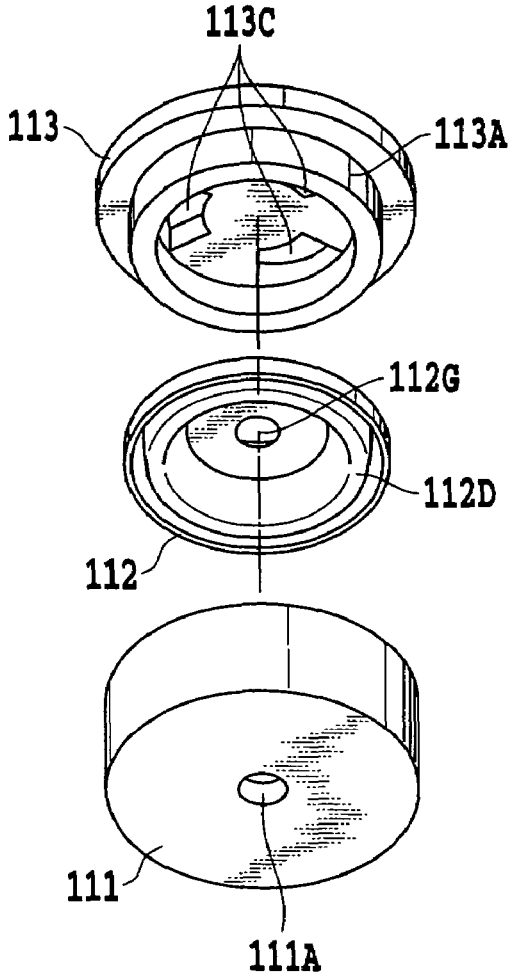

FIGS. 1 to 4 illustrate a basic construction of an ink tank 100 accommodating only a single color ink (in this example, a black ink); FIG. 5 and FIG. 6 illustrate a basic construction of an ink tank 200 accommodating a plurality of color inks (in this example, magenta, cyan and yellow inks); FIG. 7 is a perspective view of a head cartridge 300 connectable with these ink tanks 100, 200; and FIG. 8 shows another construction of the ink tank 100 accommodating a single color ink.

In the ink tank 100 accommodating a single color ink (see FIG. 1 to FIG. 4), a case 101 and a cover 102 are combined to form an ink accommodation space S therein. A lower part of the ink accommodation space S is connected to an ink supply port 103 through a valve 110. An upper part of the ink accommodation space S is connected to an atmosphere communication hole 104.

Figure 1:
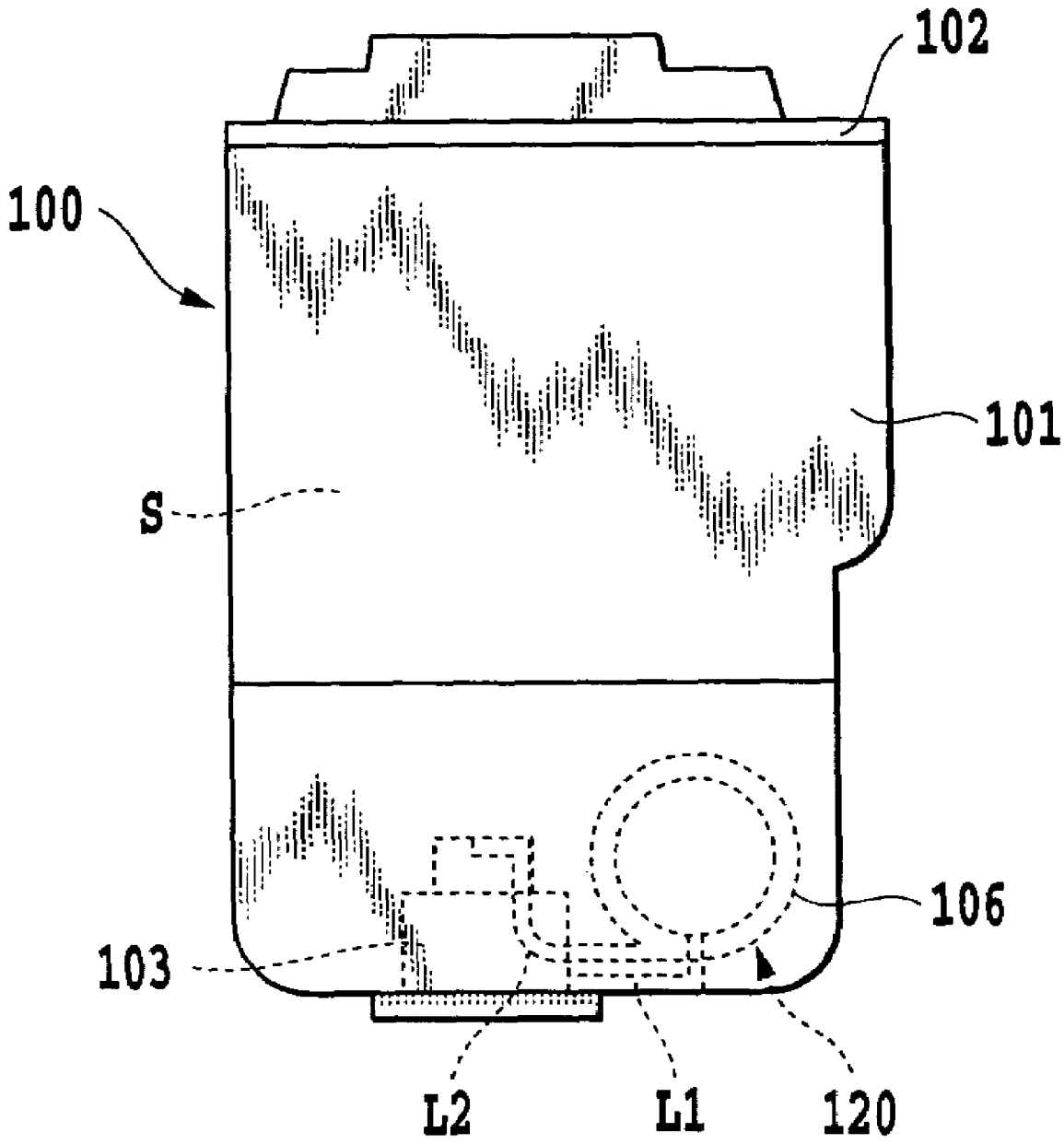
FIG. 1 is a schematic diagram showing a basic construction of an ink tank accommodating a single color ink.
Figure 2:
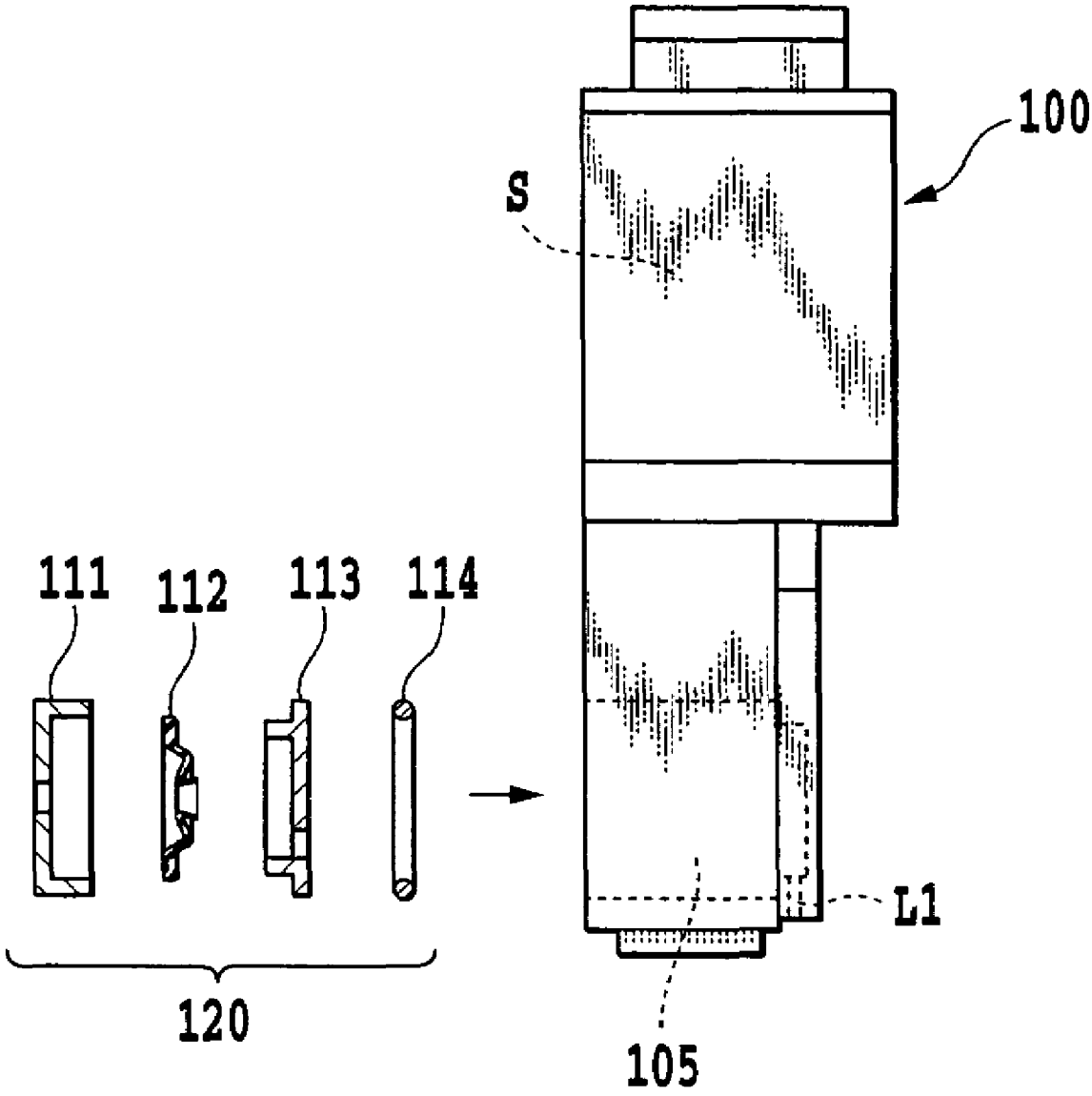
FIG. 2 is a side view of the ink tank of FIG. 1.
Figure 3:
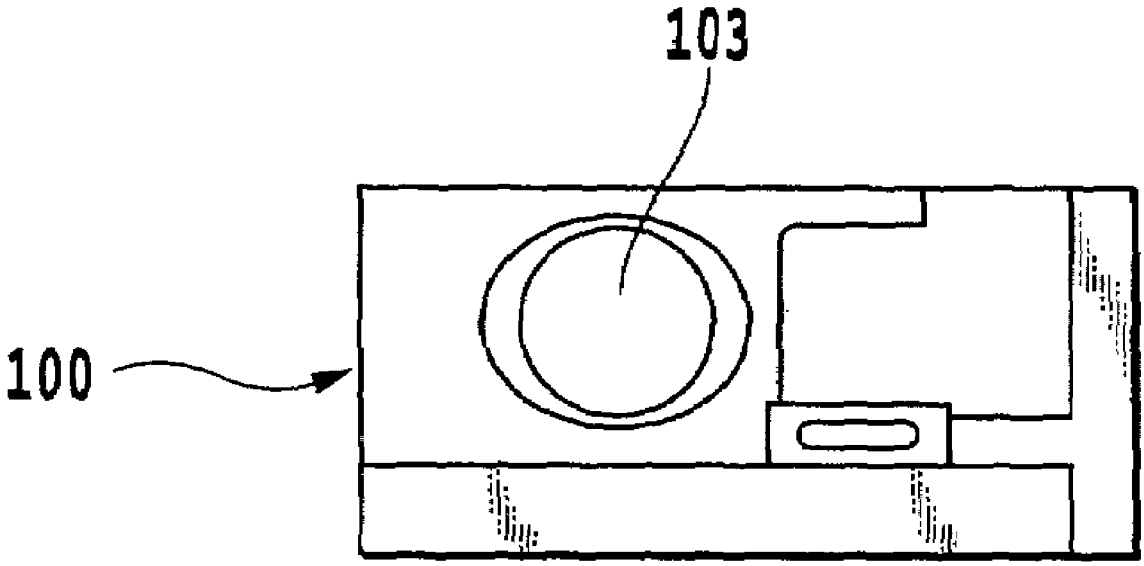
FIG. 3 is a bottom view of the ink tank of FIG. 1.
Figure 4:
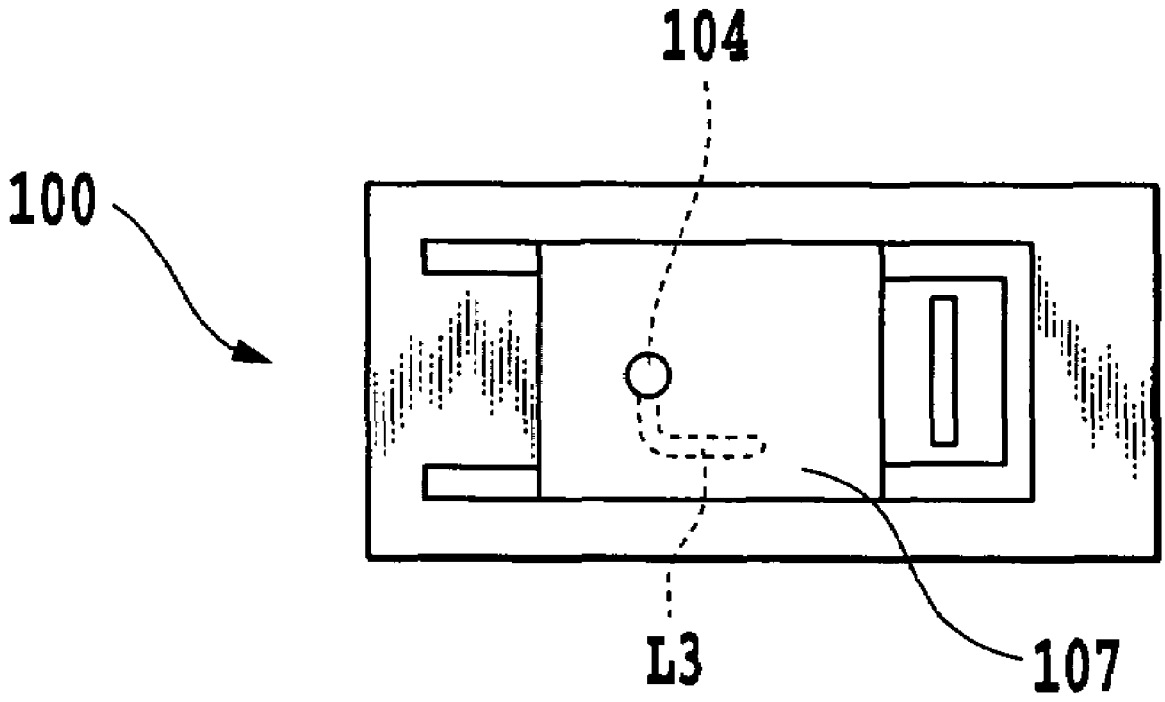
FIG. 4 is a top view of the ink tank of FIG. 1.

As shown in FIG. 2, inside the case 101 is formed a valve chamber 105 in which the valve 110 of FIGS. 9A, 9B and FIGS. 10A, 10B is installed. This valve, which will be detailed later with reference to FIGS. 9A, 9B and FIGS. 10A, 10B incorporates a housing 111, a valve rubber 112 and a flange 113. In FIG. 2, a right side of the valve chamber 105 is communicated through a flow path L1 to the ink accommodation space S and a left side of the valve chamber 105 is communicated through a flow path L2 to the ink supply port 103. Thus, the valve 110 in the valve chamber 105 lies in the ink supply path between the ink accommodation space S and the ink supply port 103. A valve unit 120 includes the valve, made up of the housing 111, valve rubber 112 and flange 113, and an O-ring 114.

Here, referring to FIGS. 9A, and 9B, FIG. 10A and FIG. 10B, an outline construction of each member making up the valve will be explained. The housing 111 is shaped like a bottomed cylinder which has a communication port 111A at a center of the bottom communicating with the flow path L2 on the ink supply port 103 side. The valve rubber 112 has a cylindrical lip portion 112A, an annular edge portion 112B, and an annular folded portion 112C disposed between the lip portion 112A and the edge portion 112B. The lip portion 112A is formed thinner than the annular folded portion 112C. The edge portion 112B of the valve rubber 112 is fitted in an inner circumference of the housing 111.

The flange 113 is shaped like a circular disk and closes an opening of the housing 111. The flange 113 has on its underside a cylindrical portion 113A that fits in an inner circumference of the housing 111. A lower end of the cylindrical portion 113A presses the edge portion 112B to hold the valve rubber 112 in its place. The flange 113 is formed with a communication port 113C connected to the flow path L1 on the ink accommodation space S side.

The housing 111 and the flange 113 are made of a plastic material and their joint surfaces are joined together as by ultrasonic fusing. The housing 111, valve rubber 112 and flange 113 along with the O-ring 114 form the valve unit 120. The valve unit 120, as described above, is incorporated into the valve chamber 105 formed in the case 101 of the ink tank. With the valve unit 120 installed in the valve chamber 105, an opening of the valve chamber 105 is closed by fusing a valve film 106 to the opening. The flow path L2 can also be formed using the valve film 106, as by forming a groove in the surface of the case 101 and fusing the valve film 106 to the surface of the case 101 to close the open groove. A path L3 connecting the ink accommodation space S to the atmosphere communication hole 104 is formed by a groove formed in the surface of the cover 102 and a film 107 fused to the surface of the cover 102 to close the open groove.

The ink tank 100 of this construction, after being fitted in the head cartridge 300 as shown in FIG. 7, is mounted together with the head cartridge 300 in a printing apparatus. In a serial scan type printing apparatus, the ink tank 100 fitted in the head cartridge 300 is mounted on a carriage that travels in a main scan direction. The head cartridge 300 has an ink jet print head that ejects ink supplied from the ink accommodation space S through the valve unit 120 and the ink supply port 103. The print head may use heaters or piezoelectric elements as a means for generating an ink ejection energy. In a system that uses heaters, the heaters transform electric energy into thermal energy which generates bubbles in ink to eject ink droplets from nozzles by a pressure of expanding bubbles.

The valve 110 basically functions as follows. Normally, the valve rubber 112 has its lip portion 112A pressed hermetically against an underside of the flange 113 by an elastic recovery force of the annular raised portion 112C, forcing the lip portion 112A to expand in diameter toward its free end (upward in FIG. 10A). Since the lip portion 112A is thinner than other portion, it has a smaller stiffness and is more easily deformable. That is, the lip portion 112A is capable of following the shape of the flange 113 and thus can be brought into reliable, intimate contact with the flange with a relatively weak pressing force. As the lip portion 112A is pressed against the flange 113, the free end of the lip portion 112A is deformed and expanded. The easily deformable lip portion 112A therefore can remain in reliable and hermetic contact with the flange 113 without forming wrinkles at its engagement portion. As a result, the interior of the housing 111 is divided into a valve chamber R1 on the ink accommodation space S side and a valve chamber R2 on the ink supply port 103 side, closing the ink supply path. When, after ink ejection from the print head, a pressure in the ink supply path on the ink supply port 103 side falls below a predetermined level, the annular raised portion 112C of the valve rubber 112 is deformed to open the ink supply path communicating the ink accommodation space S to the ink supply port 103. This allows ink to flow from the ink accommodation space S to the ink supply port 103, increasing the pressure in the ink supply port 103. As a result, the lip portion 112A is again brought into hermetic contact with the underside of the flange 113 by the elastic recovery force of the annular raised portion 112C of the valve rubber 112, blocking the ink supply path.

The ink tank 200 accommodating a plurality of color inks (see FIG. 5 and FIG. 6) has a similar construction to that of the ink tank 100 accommodating a single color ink. Inside the ink tank 200 are formed spaces for accommodating three different inks. These ink accommodation spaces are connected to ink supply ports 103A, 103B, 103C through valves 110A, 110B, 110C that function as negative pressure generation means. In this example, two valves 110A, 110B are arranged on one side of the ink tank 200 and one valve 110C is arranged on the other side. The head cartridge 300 (FIG. 7) has an ink jet print head to eject inks supplied from the ink supply ports 103A, 103B, 103C through the valves 110A, 110B, 110C of the ink tank 200. These valves 110A, 110B, 110C open and close according to the similar basic operation to that of the valve 110 of the ink tank 100.

The ink tank 100 of FIG. 8 accommodating a single color ink is mounted on a different type of head cartridge 300 from the one shown in FIG. 7. The case 101 is formed with an engagement claw 101A and a latch lever 101B for engagement with the head cartridge. In other respects the construction is similar to the ink tank of FIG. 1 to FIG. 4.

Next, characteristic construction and operation of this invention as opposed to the basic construction and operation will be described as follows in first to third embodiment.

First Embodiment

Figure 11B:
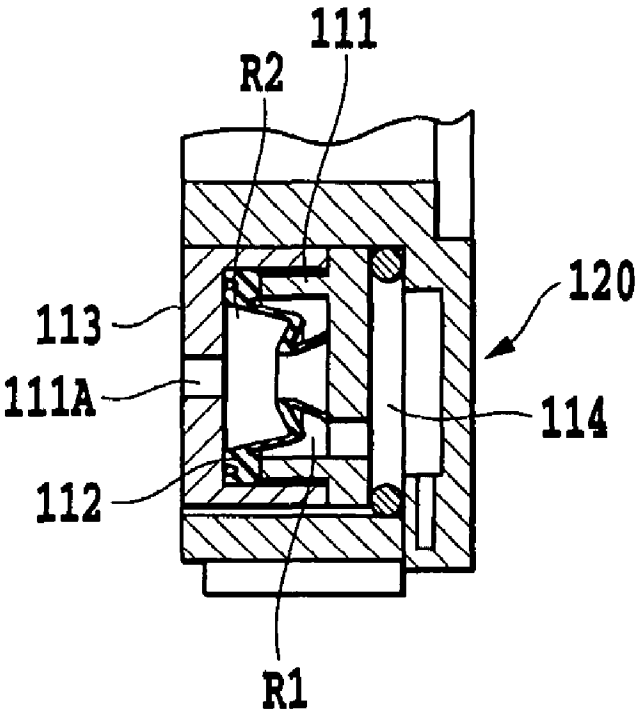
FIG. 11B is a cross-sectional view taken along the line A—A of FIG. 11A showing an essential part of the ink tank in the first embodiment of this invention.
Figure 11A:
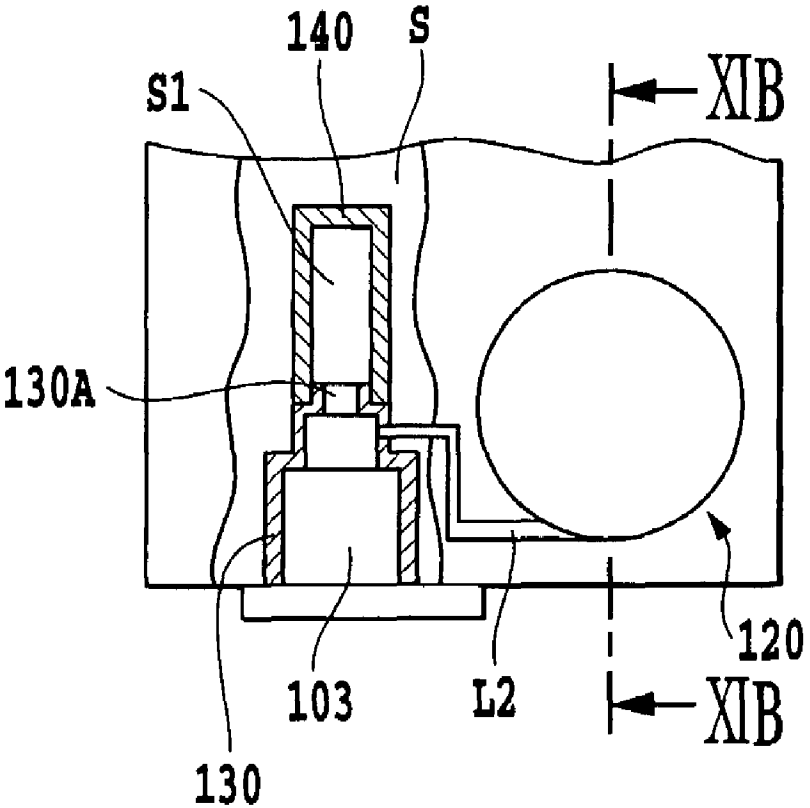
FIG. 11A is a vertical cross-sectional side view showing an essential part of the ink tank in a first embodiment of this invention, with a part of a damper shown enlarged.

The ink tank 100 of this embodiment has a cylindrical head mounting portion 130 (FIGS. 11A and 11B) in which a tank mounting portion of the print head is inserted when the ink tank is installed in the head cartridge. The opening of the head mounting portion 130 forms the ink supply port 103 of the ink tank. A side surface of an upper part of the head mounting portion 130 is connected to the valve unit 120 through the flow path L2. An upper end of the head mounting portion 130 is formed with a through-hole 130A.

The upper end portion of the head mounting portion 130, as shown in FIG. 11A, FIG. 11B, FIG. 12A and 12B is securely and tightly fitted with a lower end portion of a damper 140 shaped like a cylinder with its head closed. The damper 140 is formed of an elastic member impermeable to liquid. The damper 140 is elastically deformable by less than a negative pressure at which the valve rubber 112 of the valve unit 120 is deformed (open). While the damper 140 is formed of rubber in this example, it can be formed of other materials.

As described above, in this first embodiment, a damper space Si formed by the damper 140 is provided in a path from the valve unit 120 to the ink supply port 103. This is what differs from the basic construction described above. The damper 140 protrudes into the ink accommodation space S of the ink tank 100 and is normally surrounded by ink. Thus, the material of the damper 140 needs only to be impervious to liquid and may be permeable to gas.

Figure 16:
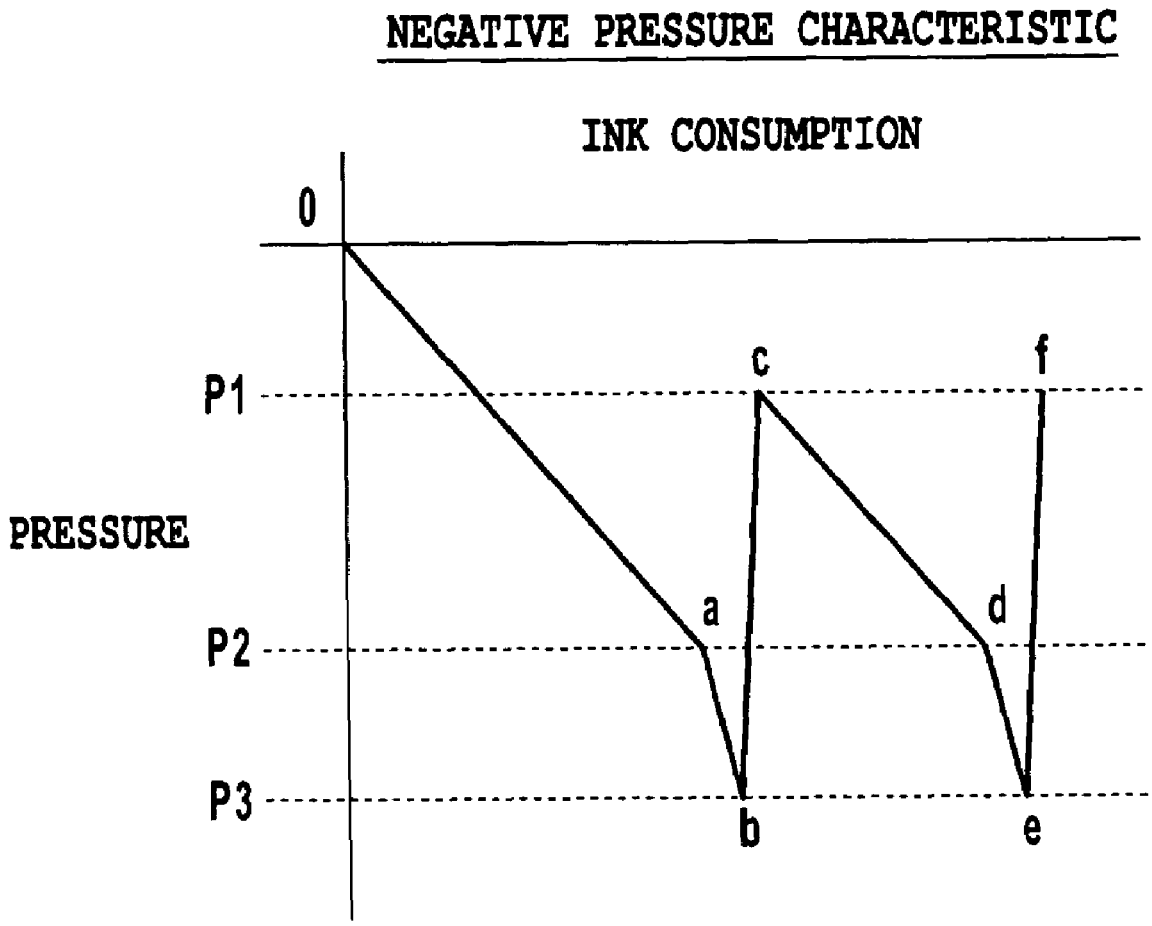
FIG. 16 is a negative pressure characteristic curve showing a negative pressure generated in a valve chamber R2 on the ink supply port side when a print head using the ink tank of the first embodiment of this invention is operated.

With the ink tank 100 of the first embodiment of the above construction mounted on the head cartridge 300, a printing operation is started by ejecting ink from the print head. As the ink ejection operation proceeds, the pressure in the print head and in the supply path in the ink tank 100 on the ink supply port side (including the valve chamber R2) which communicates with the print head decreases (the negative pressure increases). A negative pressure characteristic curve is shown in FIG. 16. At an initial stage immediately after the ink tank 100 is mounted on the head cartridge 300, almost no negative pressure is produced as indicated at point 0 in the figure. As the ink ejection operation proceeds, the negative pressure in the path on the ink supply port 103 side begins to rise from this state. When the negative pressure changes from point 0 to point a, i.e., when it reaches a level P2 in FIG. 16, the damper 140 is deformed in a direction that contracts its inner volume, as shown in FIG. 12E (state 2). When a further ink ejection operation changes the negative pressure in the supply path on the ink supply port 103 side (negative pressure in the valve chamber R2) from level P2 at point a to level P3 at point b, the damper 140 is constricted further as shown in FIG. 12F and finally reaches a state 3.

Figure 10A:
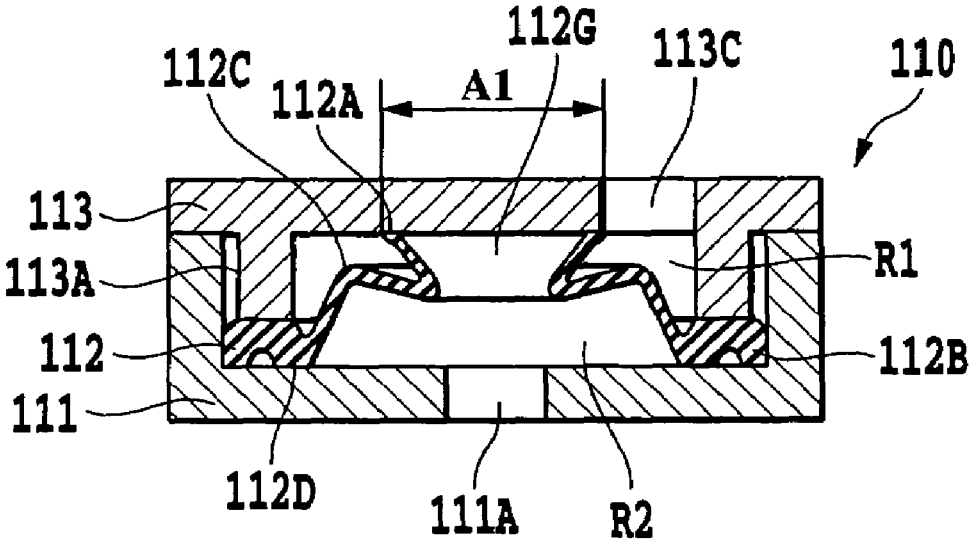
FIG. 10A is a vertical cross-sectional side view of the valve into which the constituent parts of FIGS. 9A and 9B are assembled, the valve being in a closed state.

Until the negative pressure P3 is reached, the valve rubber 112 of the valve unit 120 maintains a closed state of FIG. 10A by its own elastic force, with the lip portion 112A held in hermetic contact with the underside of the flange 113. Thus, the ink flow path L2 from the ink accommodation space S to the ink supply port 103 is closed.

Figure 10B:
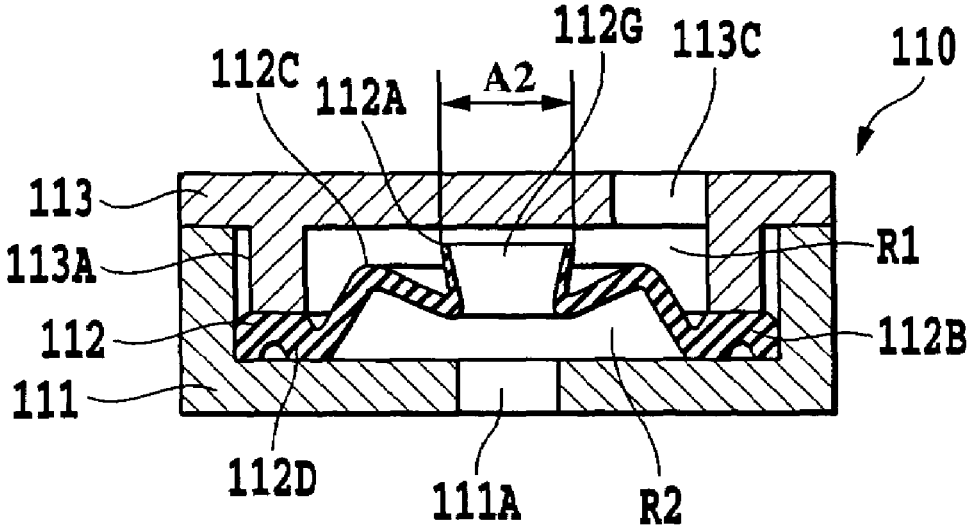
FIG. 10B is a vertical cross-sectional side view of the valve into which the constituent parts of FIGS. 9 A and 9B are assembled, the valve being in an open state.

When the negative pressure in the valve chamber R2 reaches the level P3 as shown in FIG. 16, it overcomes the elastic force of the valve rubber 112 elastically deforming the valve rubber 112 toward the ink supply port side, as shown in FIG. 10B. As a result, the lip portion 112A of the valve rubber 112 parts from the flange 113, opening the valve unit 120 and allowing ink to flow from the ink accommodation space S through the valve chamber R1 to the valve chamber R2, from which ink is further supplied to the print head.

After ink is supplied, the negative pressure in the print head and in the flow path L2 on the ink supply port 103 side decreases (pressure rises). Thus, the elastic force of the valve rubber 112 overcomes the negative pressure, forcing the lip portion 112A to come into hermetic contact with the underside of the flange 113 again to close the valve unit 120, as shown in FIG. 10A. At this time, the damper 140, which was elastically deformed in a contracting direction as shown in FIG. 12F during a period from point 0 to point b of FIG. 16, has not yet recovered completely from the elastically deformed state to its original state and still remains, for example, in a state of FIG. 12E (state 2). Thus, even after the valve unit 120 is closed, the negative pressure in the flow path L2 on the ink supply port 103 side is kept at level P1 by the elastic recovery force as shown at point c of FIG. 16 and the flow path L2 is not completely cleared of the negative pressure. Therefore, this negative pressure P1 present in the flow path L2 including the damper space S1 is applied to the nozzles of the print head communicating with the flow path L2, thus keeping ink meniscuses formed in the nozzles in good condition. This enables correct ejection and landing of ink droplets, resulting in high-quality printed images. This can also prevent ink droplets from inadvertently leaking from the nozzles due to ambient temperature variations.

In the first embodiment, the damper 140 provided in the ink flow path from the valve unit 120 to the ink supply port 103 generates a negative pressure by its elastic recovery force after the valve unit 120 is closed, as shown at point c and f of FIG. 16. In the case of the basic construction in which only the valve unit 120 is provided in the ink flow path and no damper 140 is provided, a negative pressure characteristic curve in the ink flow path is as shown in FIG. 17.

Figure 17:
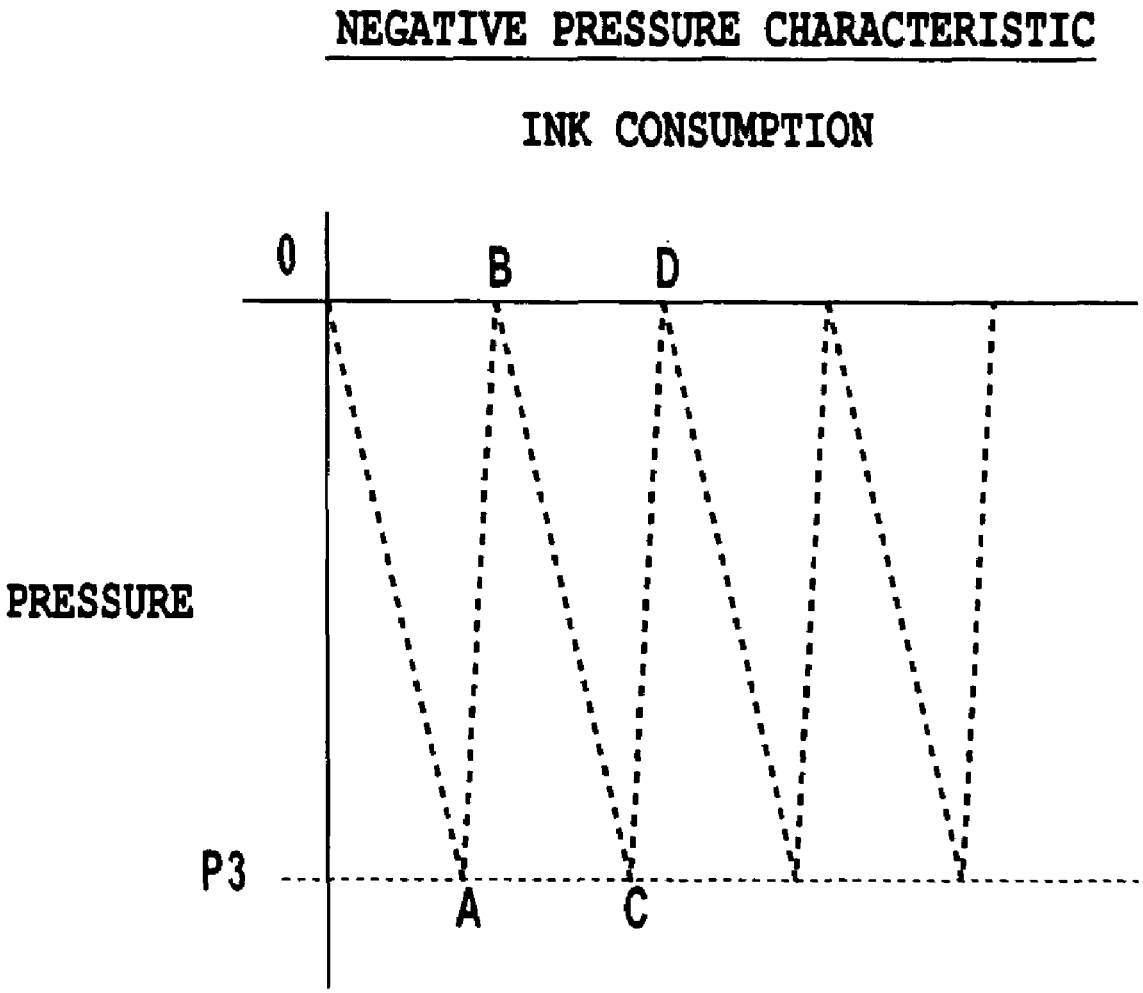
FIG. 17 is a negative pressure characteristic curve showing a negative pressure generated in the valve chamber R2 on the ink supply port side when a print head using an ink tank without the damper means of this invention is operated.
Figure 18:
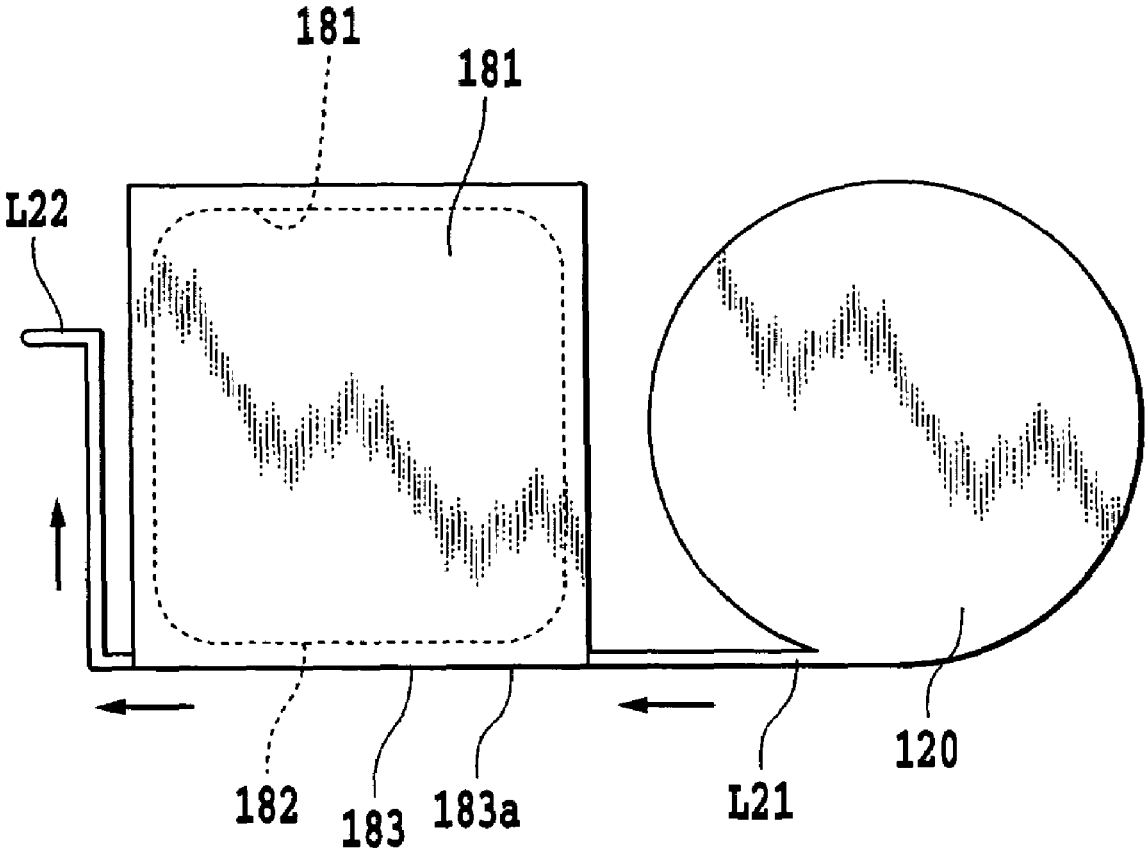
FIG. 18 is a side view showing an essential part of an ink tank of a second embodiment of this invention.

That is, if the damper 140 is not provided, when the negative pressure in the valve chamber R2 on the ink supply port 103 side reaches level P3 as shown at point A, C of FIG. 17 and the valve unit 120 opens, the pressure in the valve chamber R2 returns to the initial state (point 0) where almost no negative pressure is present, as shown at point B, D. This likely results in undesirable phenomena, such as a failure to form appropriate meniscuses in the nozzles of the print head and leakage of ink from the nozzles due to ambient temperature variations. These in turn will give rise to other problems such as degraded image quality and contamination of components with leaked ink.

Although an example case that uses the damper 140 of circular cylinder has been explained in the first embodiment, the damper 140 may be constructed in other shape. The only requirement is that the damper 140 needs to be formed of an elastic member that can be elastically deformed at less than a negative pressure at which the valve rubber 112 of the valve unit. 120 deforms (opens). There is no limiting condition on the shape of the damper 140. For example, a cylindrical member of such shapes as shown in FIGS. 13A–13D, FIGS. 5A–15H may be used.

A damper 150 shown in FIGS. 13A–13F is formed by pressing flat one of open ends of a tube member and performing a predetermined bonding treatment on that end. Since this damper has a transverse cross section slightly more flat than that of FIGS. 12A–12F, its side portions always deflect in a predetermined direction as shown in FIGS. 13E and 13F whenever a negative pressure is generated, thus producing a stable deformation with a relatively small negative pressure.

A damper 160 shown in FIGS. 14A–14F has a cylinder with its lower end open and two inclined surfaces 161, 162 formed at a top of the cylinder. With this construction, a negative pressure acts on the inclined surfaces 161, 162. These inclined surfaces are more easily deformed as shown in FIGS. 14E and 14F than the side deformable portions are which have curved surfaces as shown in FIGS. 12A–12F, and FIGS. 13A–13F The inclined surfaces can thus be deformed with a smaller negative pressure.

Figure 15A:
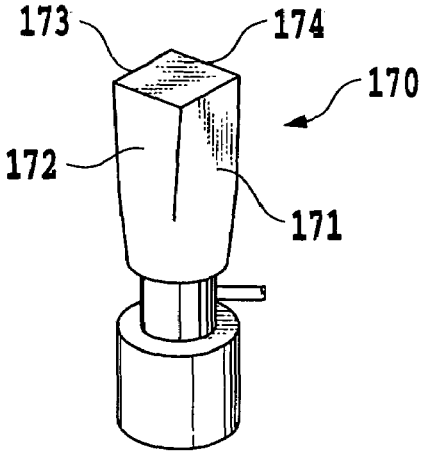
FIG. 15A is a perspective view of a damper mounted on the head mounting portion in a third variation of the first embodiment of this invention.
Figure 15B:
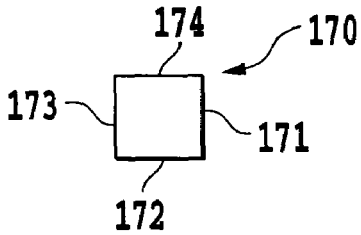
FIG. 15B is a top view of the damper of FIG. 15A in the third variation of the first embodiment of this invention.
Figure 15G:
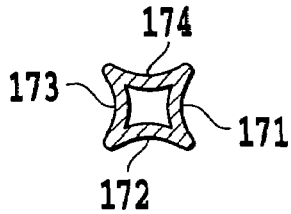
FIG. 15G is a horizontal cross-sectional view of the damper in state 3 in the third variation of the first embodiment of this invention.
Figure 15C:
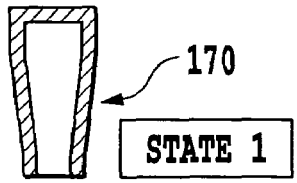
FIG. 15C is a vertical cross-sectional side view of the damper in state 1 in the third variation of the first embodiment of this invention.
Figure 15D:
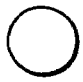
FIG. 15D is a bottom view of the damper in the third variation of the first embodiment of this invention.
Figure 15H:
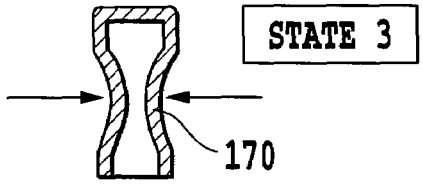
FIG. 15H is a vertical cross-sectional side view of the damper in state 3 in the third variation of the first embodiment of this invention.
Figure 15E:
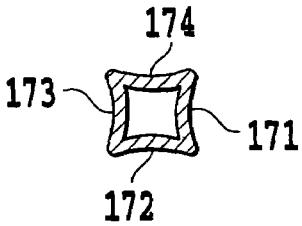
FIG. 15E is a horizontal cross-sectional view of the damper in state 2 in the third variation of the first embodiment of this invention.
Figure 15F:
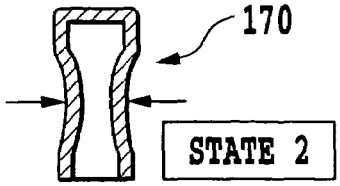
FIG. 15F is a vertical cross-sectional side view of the damper in state 2 in the third variation of the first embodiment of this invention.

A damper 170 shown in FIGS. 15A-15G comprises a cylinder with its top end closed and lower end open and has its cylinder side surface formed with four planar surfaces so that at least an upper half of the cylinder is shaped like a square column square in horizontal cross section. A negative pressure therefore can easily deflect these flat surfaces of the damper, as shown in FIGS. 15E–15G. Further, since the four flat surfaces—front, rear, left and right—forming an outer circumferential surface are deflected uniformly inwardly, a deformation can be maintained stably at all times, making it possible to realize a stable negative pressure generation function. Although in the example of FIGS. 15A–15G the cross section of the damper 170 is close to square, other shapes may be used. For example, the cross section of the damper may be a rectangular with a larger aspect ratio to allow the damper to be elastically deformed in response to a smaller pressure variation and therefore by a smaller negative pressure.

Second Embodiment

Next, a second embodiment of this invention will be described.

The second embodiment has a thin damper (damper means) 180 formed in sidewalls of the ink tank as shown in FIG. 18 and FIGS. 19A–19C in place of the cylindrical dampers 140, 150, 160, 170 used in the first embodiment. The constructions of other components including the valve unit 120 are similar to those of the first embodiment.

In the ink tank 100 described above, the damper 180 is provided in the ink flow path L2 from the valve unit 120 to the ink supply port 103 and is formed in the same sidewall in which the valve unit 120 is formed. The damper 180 comprises a recessed portion 181 formed in the sidewall of the case 101 of the ink tank 100 and a resilient film body 183 whose peripheral portion is hermetically and securely fixed to the recessed portion 181, thus defining therein a generally thin rectangular parallelepiped space. One end (upstream side) of the damper 180 is connected to an ink flow path L21 extending downstream from the valve chamber R2 of the valve unit 120. The other end (downstream side) of the damper 180 is connected to an ink flow path L22 extending upstream from the ink supply port 103.

In the second embodiment, the film body 183 is formed into a three-dimensional shape with side surfaces and a top surface by heating and molding in a die corresponding to the shape of the recessed portion 181 a flat resilient film of a size that considers the plan-view shape of the recessed portion 181 (in this example, square shape) and its depth. The film body 183 has at its periphery a flange 183*a* that matches a step 182 formed in the recessed portion 181 and which is hermetically secured to the step 182 as by fusing and bonding. The ink flow paths L21, L22 are formed to pass through the sidewall of the case 101.

After the ink tank of the above construction is mounted on the head cartridge 300 installed in an ink jet printing apparatus, a printing operation is started. As an ink ejection operation proceeds, a negative pressure develops in the ink supply path from the valve chamber R2 of the valve unit 120 to the ink supply port 103 according to a negative pressure characteristic curve of FIG. 16 as in the first embodiment.

Figure 19A:
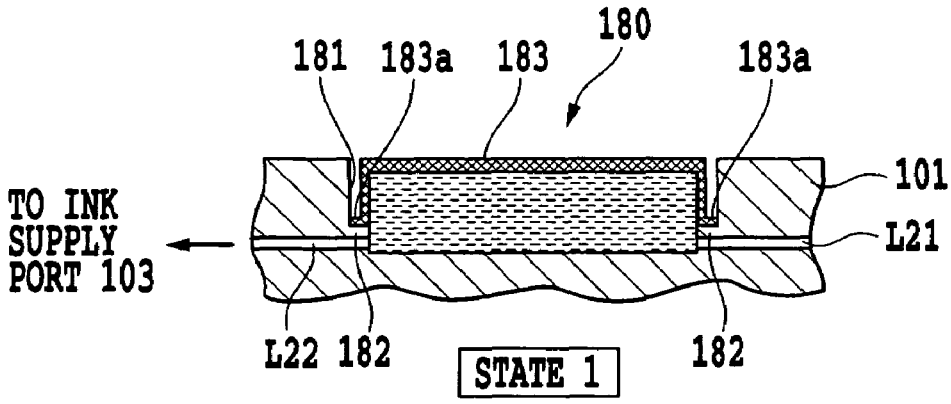
FIG. 19A a horizontal cross-sectional view of an ink tank damper of FIG. 18 in an initial state in which a film body is not deformed (state 1)
Figure 19B:
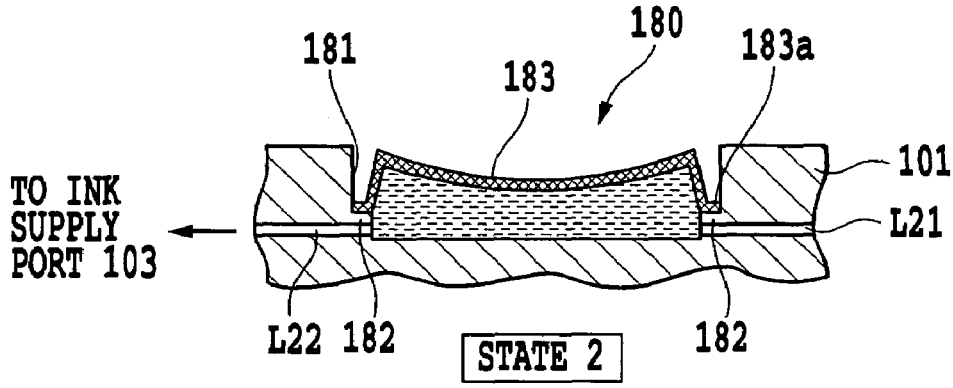
FIG. 19B is a horizontal cross-sectional view of the ink tank damper of FIG. 18 in a state in which the film body is deformed (state 2)

At an initial stage immediately after the ink tank 100 is mounted on the head cartridge 300, almost no negative pressure is produced in the valve chamber R2 as indicated at point 0 in FIG. 16. In this state an outer surface of the film body 183 of the damper 180 is flat as shown in FIG. 19A (state 1). When a further ink ejection operation changes the negative pressure from point 0 to point a on the negative pressure curve of FIG. 16, the damper 180 is deformed in a direction that reduces its inner volume, as shown in FIG. 19B (state 2). When a further ink ejection operation changes the negative pressure in the ink flow path L22 on the ink supply port 103 side (negative pressure in the valve chamber R2) from level P2 at point a to level P3 at point b, the damper 180 is further deformed in the volume-reducing direction, finally reaching a state 3 (see FIG. 19C).

Until the negative pressure P3 is reached, the valve rubber 112 of the valve unit 120 maintains a closed state of FIG. 10A by its own elastic force, with the lip portion 112A held in hermetic contact with the underside of the flange 113. Thus, the ink flow path L2 (L21, L22) from the ink accommodation space S to the ink supply port 103 is closed.

When the negative pressure in the valve chamber R2 reaches the level P3, it overcomes the elastic force of the valve rubber 112 elastically deforming the valve rubber 112 toward the ink supply port side, as shown in FIG. 10B. As a result, the lip portion 112A of the valve rubber 112 parts from the flange 113, opening the valve unit 120 and allowing ink to flow from the ink accommodation space S through the valve chamber R1 to the valve chamber R2, from which ink is further supplied to the print head.

Figure 19C:
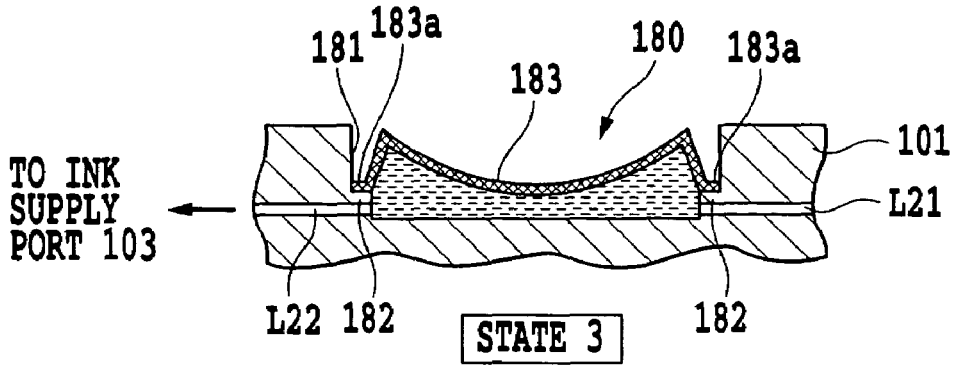
FIG. 19C is a horizontal cross-sectional view of the ink tank damper of FIG. 18 in a state in which the film body is further deformed (state 3)

After ink is supplied, the negative pressure in the print head and in the flow path L2 on the ink supply port 103 side decreases (pressure rises). Thus, the elastic force of the valve rubber 112 overcomes the negative pressure, forcing the lip portion 112A to come into hermetic contact with the underside of the flange 113 again to close the valve unit 120, as shown in FIG. 10A. At this time, the film body 183 of the damper 180, which was elastically deformed in a volume-reducing direction as shown in FIG. 19C during a period from point 0 to point b, has not yet recovered completely to its original state (state 1) and still remains, for example, in a state of FIG. 19B (state 2). Thus, even after the valve unit 120 is closed, the negative pressure in the flow path L2 on the ink supply port 103 side is kept at level P1 as shown at point c of FIG. 16 and the flow path L2 is not completely cleared of the negative pressure. Therefore, this negative pressure P1 present in the flow path L2 including the damper space is applied to the nozzles of the print head communicating with the flow path L2, thus keeping ink meniscuses formed in the nozzles in good condition. This enables correct ejection and landing of ink droplets, resulting in high-quality printed images. This can also prevent ink droplets from inadvertently leaking from the nozzles due to ambient temperature variations.

Further, in the second embodiment since the valve unit 120 and the damper 180 are both installed in the sidewall of the case 101 of the ink tank 100, they are assembled from outside the ink tank 100 during the manufacturing process, which means that they can be assembled easily.

Third Embodiment

A third embodiment of this invention will be described by referring to FIG. 21 and FIGS. 22A–22C.

In the third embodiment a damper 190 is connected through an ink flow path to a downstream side of the valve unit 120, which has similar construction to that of the second embodiment. The damper 190 is also connected through an ink flow path L22 to the ink supply port 103. The damper 190 of the third embodiment is made by forming a through-hole 191 in the sidewall of the case 101 of the ink tank 100, by securely attaching a film body 193, which is processed by a heat treatment into a three-dimensional shape, to an inner opening of the damper hole 191, and by hermetically closing an outer opening of the damper hole 191 with a cover 194. Both ends of the damper 190 are connected with the ink flow paths L21, L22 that run through the sidewall of the case 101.

As the printing operation is performed with the ink tank of the third embodiment mounted on the head cartridge 300, the negative pressure in the valve chamber R2 of the valve unit 120 increases as shown in FIG. 16. As the negative pressure in the valve chamber R2 increases, the film body 193 elastically deforms from state 1 to state 3. After this, the elastic recovery force of the film body 193 holds the pressure in the valve chamber R2 at level P2 or higher, which in turn keeps meniscuses in the nozzles of the print head in good condition.

Further, in the third embodiment the film body 193 is not exposed to atmosphere as it is in the first embodiment. That is, the film body 193 is surrounded by ink in the ink accommodation space S of the ink tank 100. Thus, there is no possibility of air entering through the film body 193. Since the film body 193 is covered with the cover 194, it can also be protected against damage due to external force. In the third embodiment, therefore, there is no need to use a material capable of preventing ingress of air and the only requirement for the material of the film body 193 is an impermeability to a liquid. This in turn reduces a manufacturing cost and improves a freedom of design.

Fourth Embodiment

Next, a fourth embodiment of this invention will be described by referring to FIG. 23 and FIGS. 24A–24C.

An ink tank of the fourth embodiment has a single mounting hole 196 that pierces through the sidewall of the case 101. In this mounting hole 196, the valve 110 and the damper 180 of the preceding embodiments are arranged one upon the other.

Thus, in the fourth embodiment, an ink supply path is formed which ranges from the ink accommodation space S to valve chambers R1, R2 of the valve 110, the damper 180 situated outside the valve chambers, the ink flow path (corresponding to the communication port 111A formed in the housing 111 of the valve 110) and to the ink supply port 103.

The valve 110 and the damper 180 connected to the valve have the similar functions to those of the preceding embodiment and can keep the interior of the print head at a negative pressure by the elastic recovery force of the film body 183 of the damper 180 thus optimizing meniscuses in the nozzles. Further, in the fourth embodiment since the damper 180 and the valve 110 are formed at the same side-view position in the sidewall of the case 101, the film body covering the outer surface of the valve 110 can be eliminated. Further, compared with other embodiments in which the recesses or holes are formed to accommodate the valve 110 and the damper, this embodiment has a simplified construction of the case and therefore allows for the manufacture of the ink tank with less cost and greater ease.

Figure 24A:
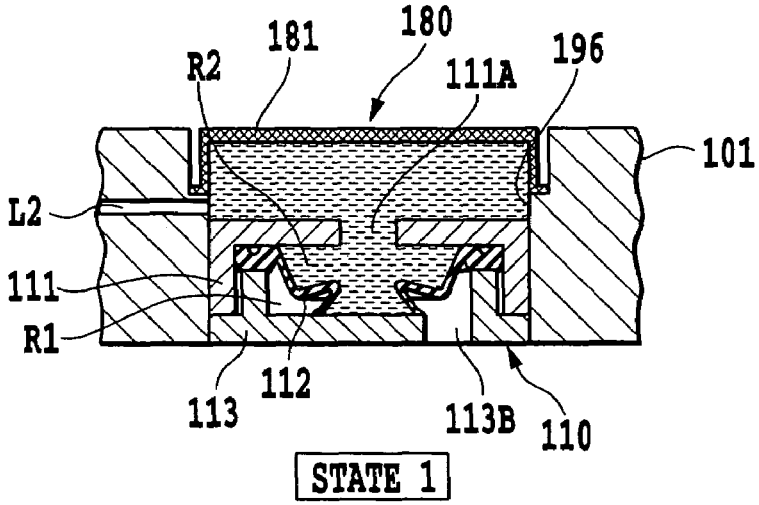
FIG. 24A a horizontal cross-sectional view of an ink tank damper of FIG. 23 in an initial state in which a film body is not deformed (state 1)
Figure 24B:
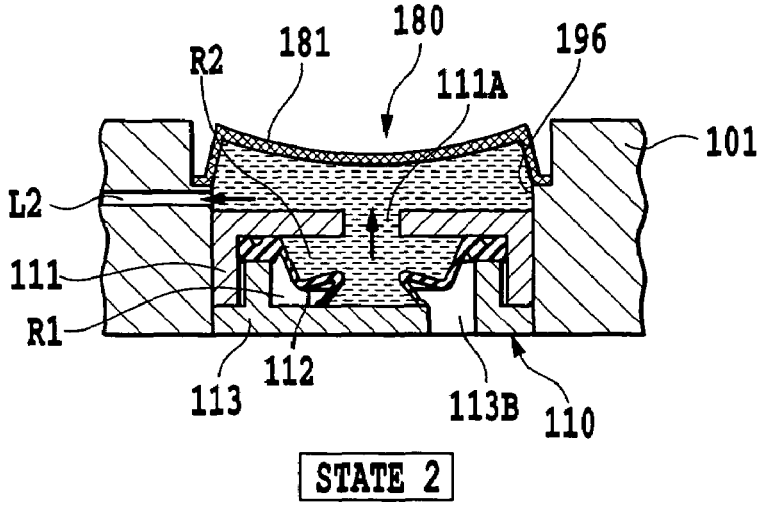
FIG. 24B is a horizontal cross-sectional view of the ink tank damper of FIG. 23 in a state in which the film body is deformed (state 2)
Figure 24C:
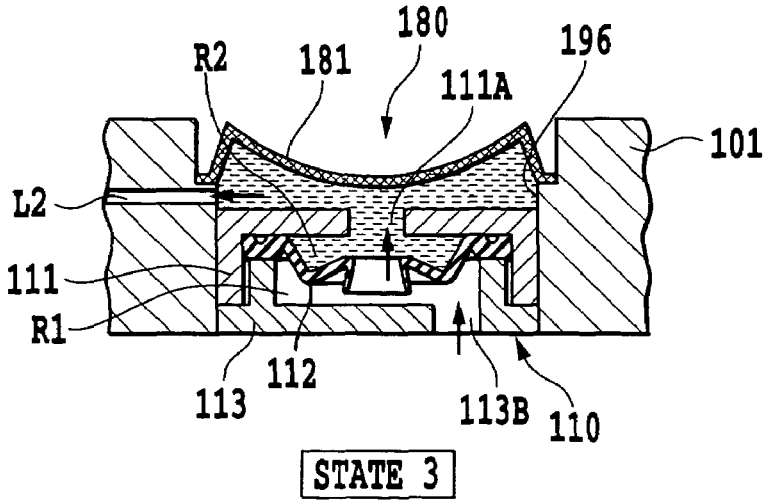
FIG. 24C is a horizontal cross-sectional view of the ink tank damper of FIG. 23 in a state in which the film body is further deformed (state 3)

In the second embodiment shown in FIG. 18 and FIGS. 19A–19C and in the fourth embodiment shown in FIGS. 24A–24C, an example case has been described in which the peripheral part of the film body 183 is hermetically and securely attached to the step 182 of the recessed portion 181 or to the inner surface of the mounting hole 196. It is noted that the shape and fixing position of the film body can be changed as needed.

Figure 20:
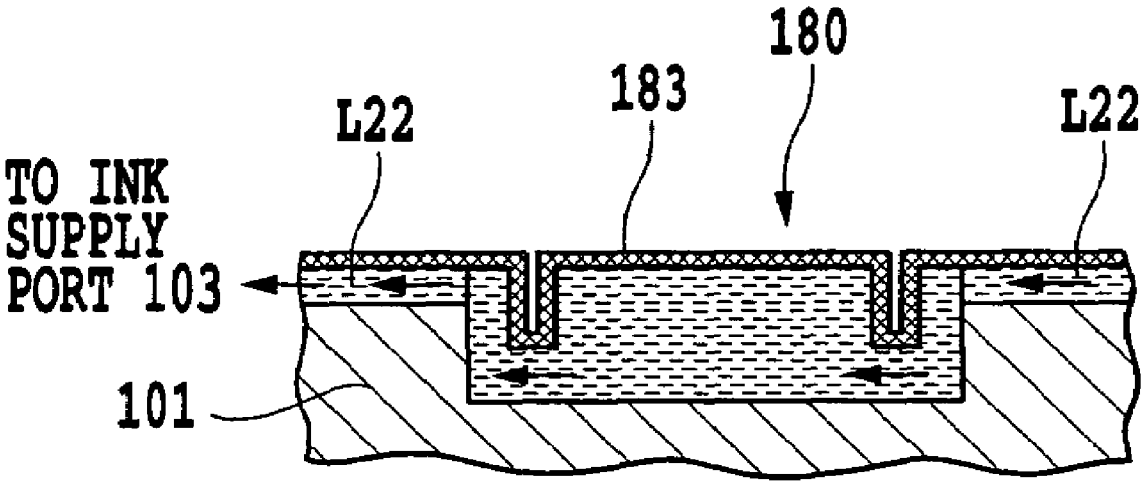
FIG. 20 is a horizontal cross-sectional view of a variation of the second embodiment of this invention.
Figure 21:
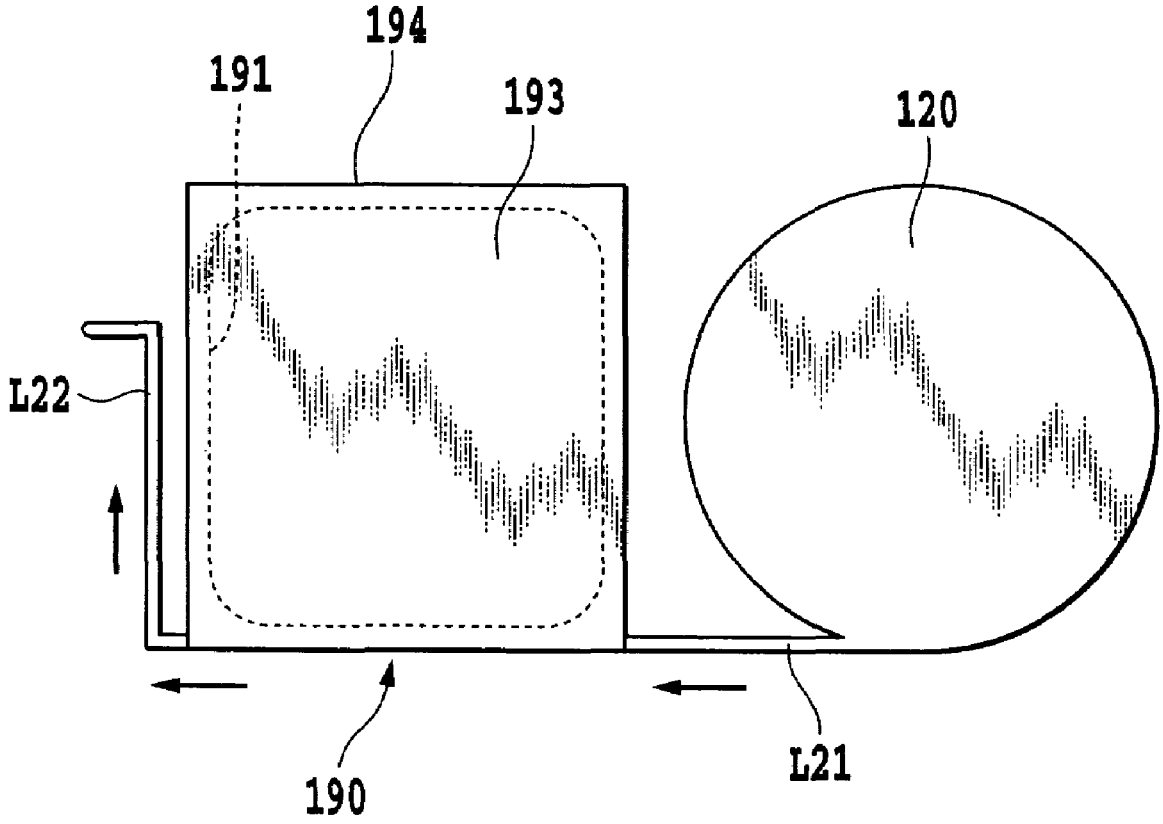
FIG. 21 is a side view showing an essential part of an ink tank of a third embodiment of this invention.
Figure 22A:
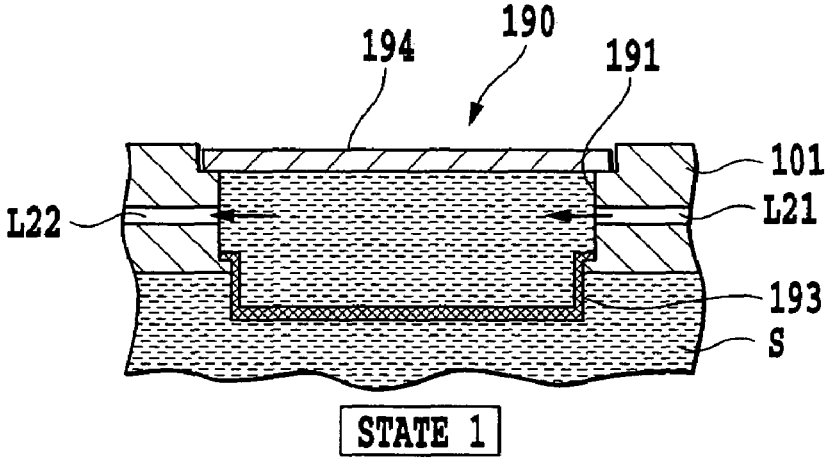
FIG. 22A is a horizontal cross-sectional view of an ink tank damper of FIG. 21 in an initial state in which a film body is not deformed (state 1)
Figure 22B:
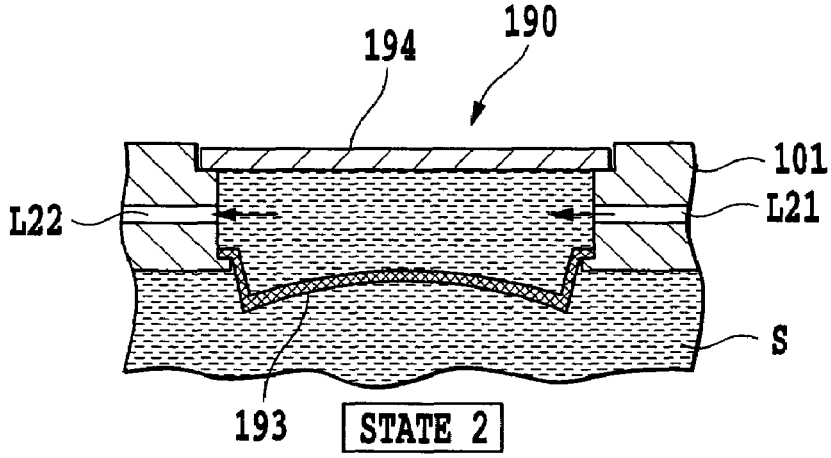
FIG. 22B is a horizontal cross-sectional view of the ink tank damper of FIG. 21 in a state in which the film body is deformed (state 2)
Figure 22C:
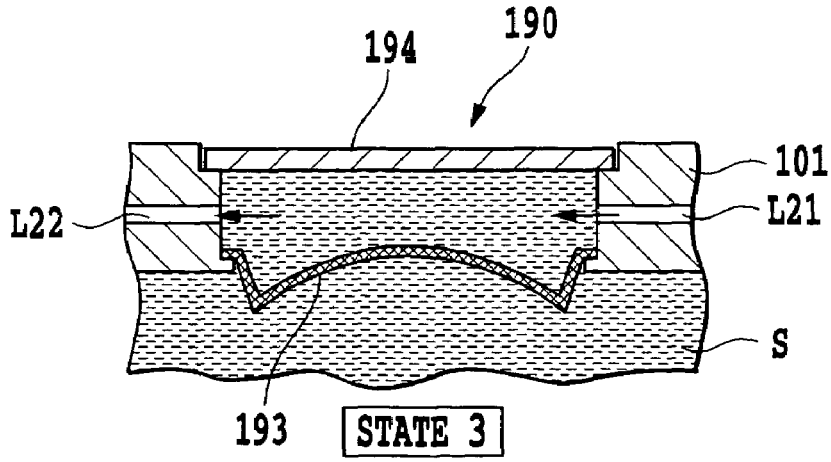
FIG. 22C is a horizontal cross-sectional view of the ink tank damper of FIG. 21 in a state in which the film body is further deformed (state 3)
Figure 23:
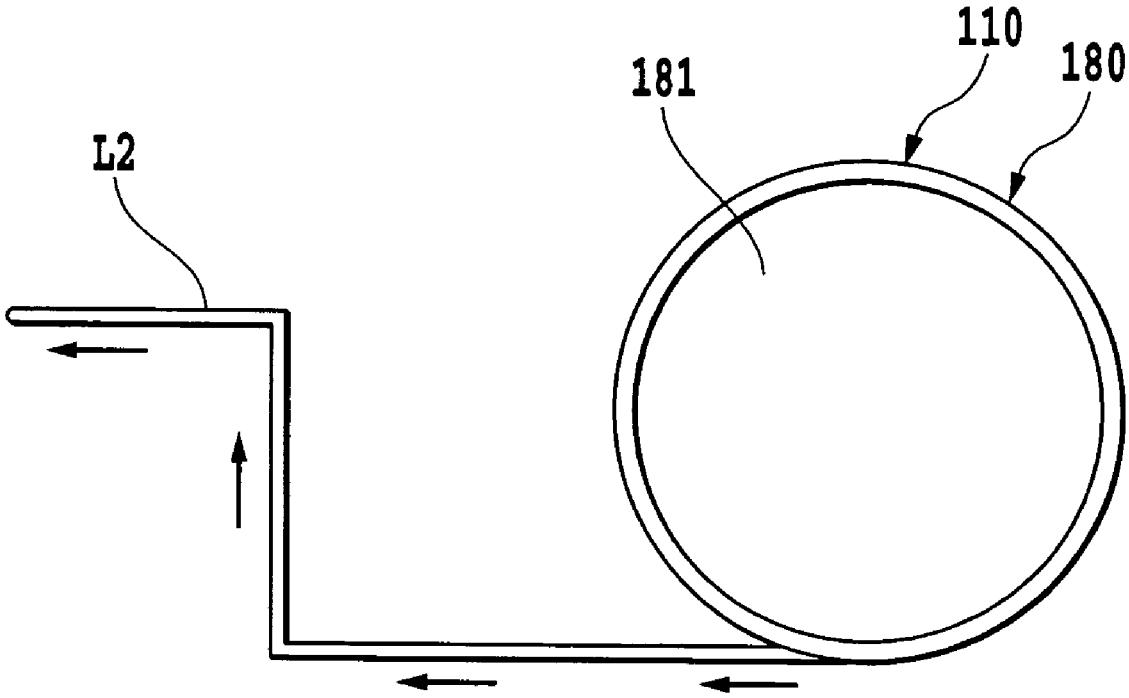
FIG. 23 is a side view showing an essential part of an ink tank of a fourth embodiment of this invention.
Figure 25:
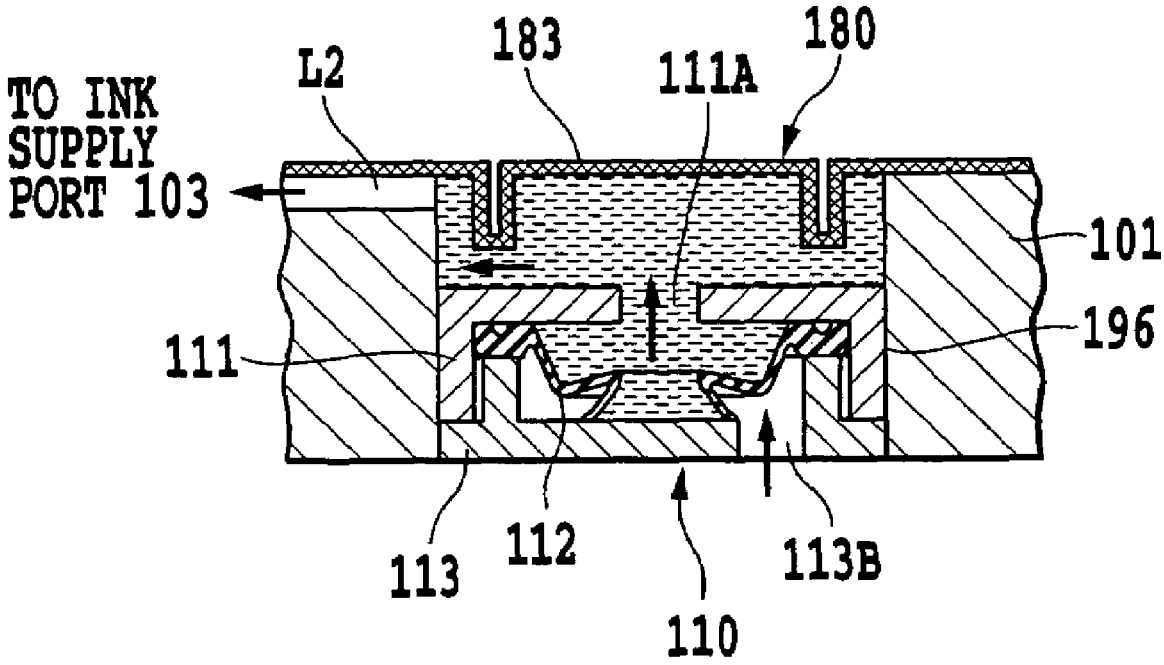
FIG. 25 is a horizontal cross-sectional view of a variation of the fourth embodiment of this invention.

For example, as shown in FIG. 20 and FIG. 25, the film body 183 may be hermetically and securely attached to the outermost surface of the case 101 to cover the recessed portion 181 of the damper or the mounting hole 196. In that case, the shape of the film body 183 does not need to precisely match the dimensions and shape of the recessed portion 181 or mounting hole 196, so the film body can be manufactured easily. If the film body is set to cover not only the recessed portion of the damper 180 but also the opening of the chamber for accommodating the valve 110 and the ink flow path groove formed in the outer surface of the case, the outer surfaces of various portions can be formed with a single film body, reducing the manufacturing cost.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink tank comprising:

an ink accommodation portion;

an ink supply port;

an ink flow path formed between the ink accommodation portion and the ink supply port;

a valve installed in the ink flow path, the valve being deformed to temporarily open the ink flow path to introduce ink from the ink accommodation portion to the ink supply port; and a damper means installed in the ink flow path between, and communicating to, the ink supply port and the valve;

wherein the damper means has a resilient member more easily deformable than the valve and applies an ink retaining force to an interior of the ink supply port by an elastic recovery force of the resilient member.

2. An ink tank comprising:

an ink accommodation portion;

an ink supply port;

an ink flow path formed between the ink accommodation portion and the ink supply port;

a valve installed in the ink flow path, the valve being deformed when a pressure in the ink supply port falls below a predetermined pressure, to temporarily open the ink flow path to introduce ink from the ink accommodation portion to the ink supply port; and a damper means installed in the ink flow path between, and communicating to, the ink supply port and the valve;

wherein the damper means has a resilient member adapted to deform prior to the valve as ink is drawn out from the ink supply port, and the damper means can apply a negative pressure to an interior of the ink supply port by an elastic recovery force of the resilient member.

3. An ink tank comprising:

an ink accommodation portion;

an ink supply port;

an ink flow path formed between the ink accommodation portion and the ink supply port;

a valve installed in the ink flow path, the valve being deformed when a pressure in the ink supply port falls below a predetermined pressure, to temporarily open the ink flow path to introduce ink from the ink accommodation portion to the ink supply port; and a damper means installed in the ink flow path between, and communicating to, the ink supply port and the valve;

wherein the damper means begins an elastic deformation at less than a predetermined pressure, some of the elastic deformation of the damper means remains after the valve has opened and closed the ink flow path, and the damper means applies an ink retaining force to an interior of the ink supply port by the residual elastic deformation.

4. An ink tank according to any one of claims 1 to 3, wherein the damper means is formed of a cylindrical resilient member communicating with an ink flow path connected to the valve and the ink supply port.

5. An ink tank according to claim 4, wherein the damper means protrudes into the ink accommodation portion.

6. An ink tank according to claim 5, wherein the damper means has formed at at least one part thereof an elastically deformable portion which is planar in shape in an initial state.

7. An ink tank according to claim 5, wherein the damper means has a portion whose transverse cross section is rectangular in an initial state.

8. An ink tank according to claim 4, wherein the damper means has a portion whose transverse cross section is rectangular in an initial state.

9. An ink tank according to claim 4, wherein the damper means has formed at at least one part thereof an elastically deformable portion which is planar in shape in an initial state.

10. An ink tank according to any one of claims 1 to 3, wherein the damper means is installed in a sidewall of the ink accommodation portion.

11. An ink tank according to claim 10, wherein the damper means comprises a recessed portion formed in the sidewall of the ink accommodation portion and a resilient film body hermetically closing an opening formed on an outer side of the recessed portion.

12. An ink tank according to claim 11, wherein the damper means comprises a through-hole formed in the sidewall of the ink accommodation portion, a resilient film body hermetically closing an opening formed on an inner side of the through-hole, and a cover hermetically closing an opening formed on an outer side of the through-hole.

13. An ink tank according to claim 11 or 12, wherein the damper means and the valve are installed one upon the other in a single through-hole formed in the sidewall of the ink accommodation portion.

14. An ink tank according to claim 10, wherein the damper means and the valve are installed one upon the other in a single through-hole formed in the sidewall of the ink accommodation portion.

* * * * *